US010426300B1

(12) United States Patent
Young

(10) Patent No.: US 10,426,300 B1
(45) Date of Patent: Oct. 1, 2019

(54) MODULAR TOILET PAPER DISPENSER WITH SHELF

(71) Applicant: George Edward Young, Sacramento, CA (US)

(72) Inventor: George Edward Young, Sacramento, CA (US)

( * ) Notice: Subject to any disclaimer, the term of this patent is extended or adjusted under 35 U.S.C. 154(b) by 0 days.

(21) Appl. No.: 16/243,478

(22) Filed: Jan. 9, 2019

(51) Int. Cl.
*A47K 10/32* (2006.01)
*A47K 10/38* (2006.01)

(52) U.S. Cl.
CPC ..... *A47K 10/3827* (2013.01); *A47K 10/32* (2013.01); *A47K 2010/3253* (2013.01)

(58) Field of Classification Search
CPC ..... A47K 10/32; A47K 10/3836; A47K 10/3827; A47K 2010/3253
See application file for complete search history.

(56) References Cited

U.S. PATENT DOCUMENTS 2,647,028 A * 7/1953 Larson ..... A47K 10/3827 225/6
3,750,971 A * 8/1973 Chevas ..... A47K 10/3836 242/594.5
4,235,333 A * 11/1980 Boone ..... A47K 10/32 206/233
6,575,316 B2 * 6/2003 Lin ..... A47K 10/38 211/107
6,698,683 B2 * 3/2004 Young ..... A47K 10/3836 242/594
6,832,739 B1 * 12/2004 Kraus ..... A47K 10/3836 242/422.5
6,974,043 B1 * 12/2005 Lai ..... A47K 10/38 211/107
6,988,691 B1 * 1/2006 Lai ..... A47K 10/38 242/594
D642,410 S * 8/2011 Vaults, Jr. ..... D6/524
8,282,034 B1 * 10/2012 Channel ..... A47K 10/38 242/597.3
D691,389 S * 10/2013 Snider ..... D6/519
9,661,959 B2 * 5/2017 Prior ..... A47K 10/40
D825,961 S * 8/2018 Vaults ..... D6/677.1
(Continued)

FOREIGN PATENT DOCUMENTS

GB 1486901 A * 9/1977 ..... A47K 10/32

*Primary Examiner* — Stanton L Krycinski
(74) *Attorney, Agent, or Firm* — Craig A. Simmermon

(57) ABSTRACT

Modular toilet paper dispenser with shelf has a modular. Modular toilet paper dispenser with shelf has four main modules: a dispenser, a stanchion, a shelf, and a base. Each module may be disassembled and assembled by hand without tools. All components of each module may be disassembled and assembled by hand without tools. The modular aspect of modular toilet paper dispenser with shelf allows the user to easily assemble toilet paper dispenser with shelf with variously colored modules according to the user's taste or according to the season of the year. For instance, during the Christmas season, the user may assemble modular toilet paper dispenser with shelf 5 with red and white modules or modules with Christmas décor on them. During Halloween the user may assemble modular toilet paper dispenser with shelf 5 with orange and black modules, or modules with Halloween décor on them, and so forth.

3 Claims, 15 Drawing Sheets

(56) References Cited

U.S. PATENT DOCUMENTS

| | | | | |
|---|---|---|---|---|
| 2009/0045083 | A1* | 2/2009 | Vaults, Jr. ..... | A47K 10/32<br>206/225 |
| 2009/0050770 | A1* | 2/2009 | Perlman ..... | A47B 23/04<br>248/346.3 |

* cited by examiner

MODULAR TOILET PAPER DISPENSER WITH SHELF

BACKGROUND OF THE INVENTION

1. Field of the Invention

This invention relates to a toilet paper or toilet tissue dispenser and specifically to a wall-mounted modular toilet paper dispenser with shelf and two rods for two spare toilet paper rolls.

2. Description of Related Art

There are many toilet paper or toilet tissue dispensers in the prior art but none include the modular design aspects, the modular shelf, the modular spare roll rods, and other aspects, as shown and described below.

BRIEF SUMMARY OF THE INVENTION

It is an aspect of modular toilet paper dispenser with shelf to dispense toilet paper or toilet tissue.

It is an aspect of modular toilet paper dispenser with shelf to include a shelf for the placement items such as a cell phone, book, magazine, notepad, etc.

It is an aspect of modular toilet paper dispenser with shelf to include storage for two spare rolls of toilet paper or toilet tissue.

It is an aspect of modular toilet paper dispenser with shelf to be attachable to a wall.

It is an aspect of modular toilet paper dispenser with shelf to be modular with components or modules that may be assembled and disassembled by hand and without tools.

It is an aspect of modular toilet paper dispenser with shelf to be a modular design with four modules that may be assembled and disassembled by hand and without tools.

Each module of modular toilet paper dispenser with shelf may be assembled and disassembled by hand and without tools.

It is an aspect of modular toilet paper dispenser with shelf to include differently colored modules so that the user may easily assemble modular toilet paper dispenser with shelf with differently colored modules.

It is an aspect of modular toilet paper dispenser with shelf to include differently decorated modules so that the user may easily assemble modular toilet paper dispenser with shelf with differently decorated modules.

It is an aspect of modular toilet paper dispenser with shelf to include a toilet paper dispenser module.

It is an aspect of modular toilet paper dispenser with shelf to include various toilet paper dispenser modules in various colors and decor.

It is an aspect of modular toilet paper dispenser with shelf to include a shelf module.

It is an aspect of modular toilet paper dispenser with shelf to include various shelf modules in various colors and decor.

It is an aspect of modular toilet paper dispenser with shelf to include a stanchion module.

It is an aspect of modular toilet paper dispenser with shelf to include various stanchion modules in various colors and decor.

It is an aspect of modular toilet paper dispenser with shelf to include a base module.

It is an aspect of modular toilet paper dispenser with shelf to include various base modules in various colors and decor.

DEFINITION LIST

Figure 1:
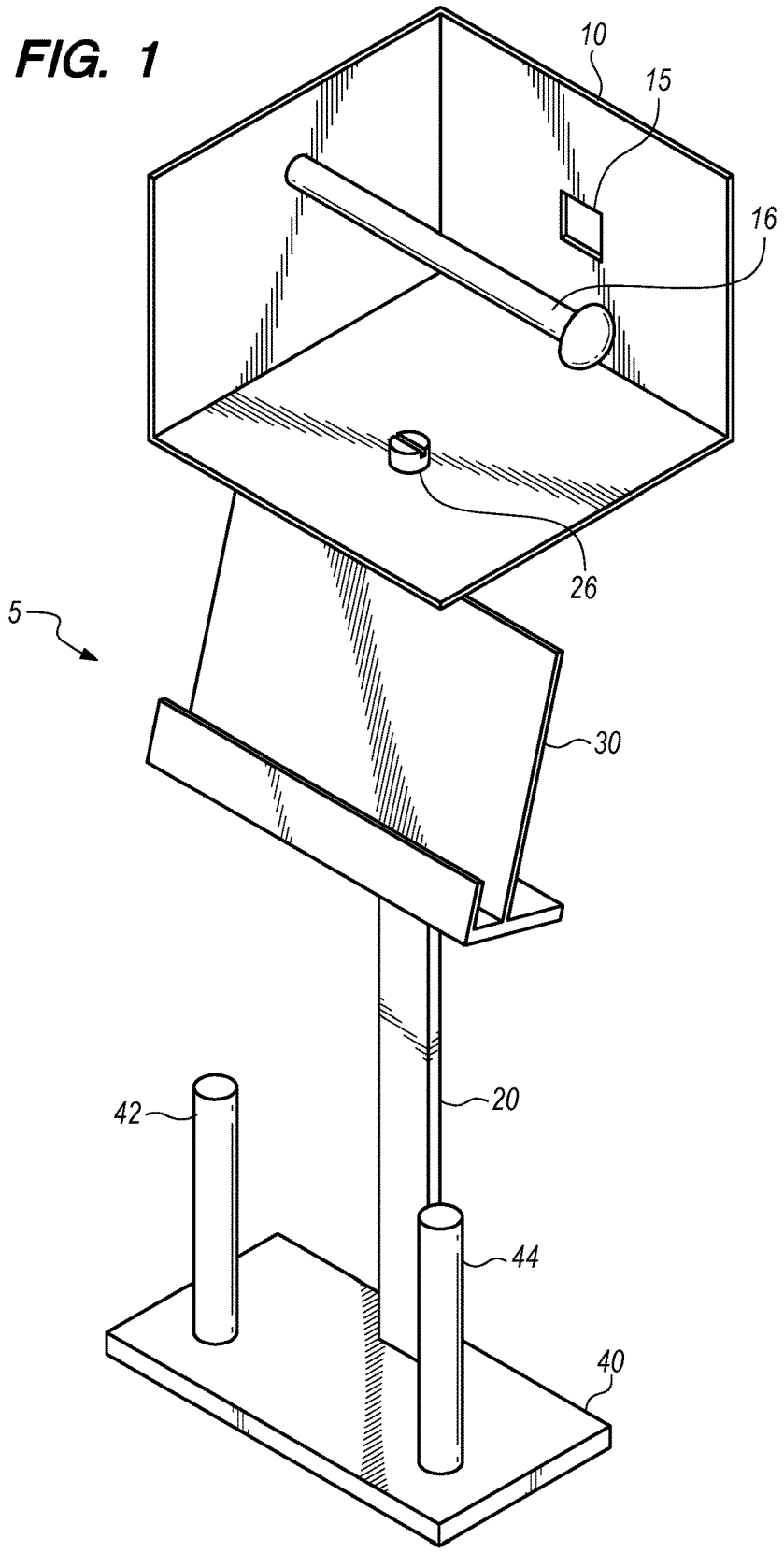
FIG. 1 is a perspective view of a first embodiment of modular toilet paper dispenser with shelf.
Figure 2:
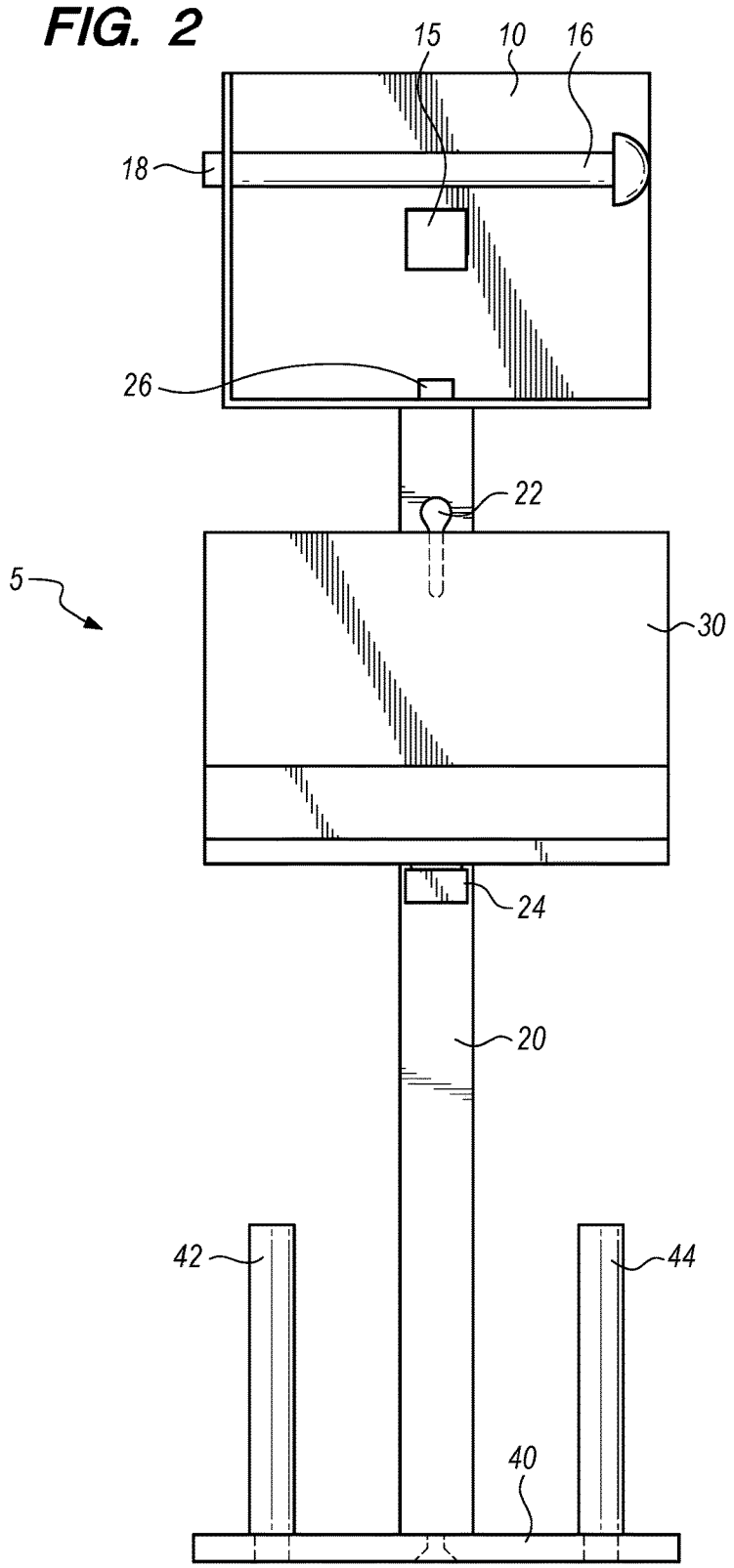
FIG. 2 is a front elevation view of a first embodiment of modular toilet paper dispenser with shelf.
Figure 3:
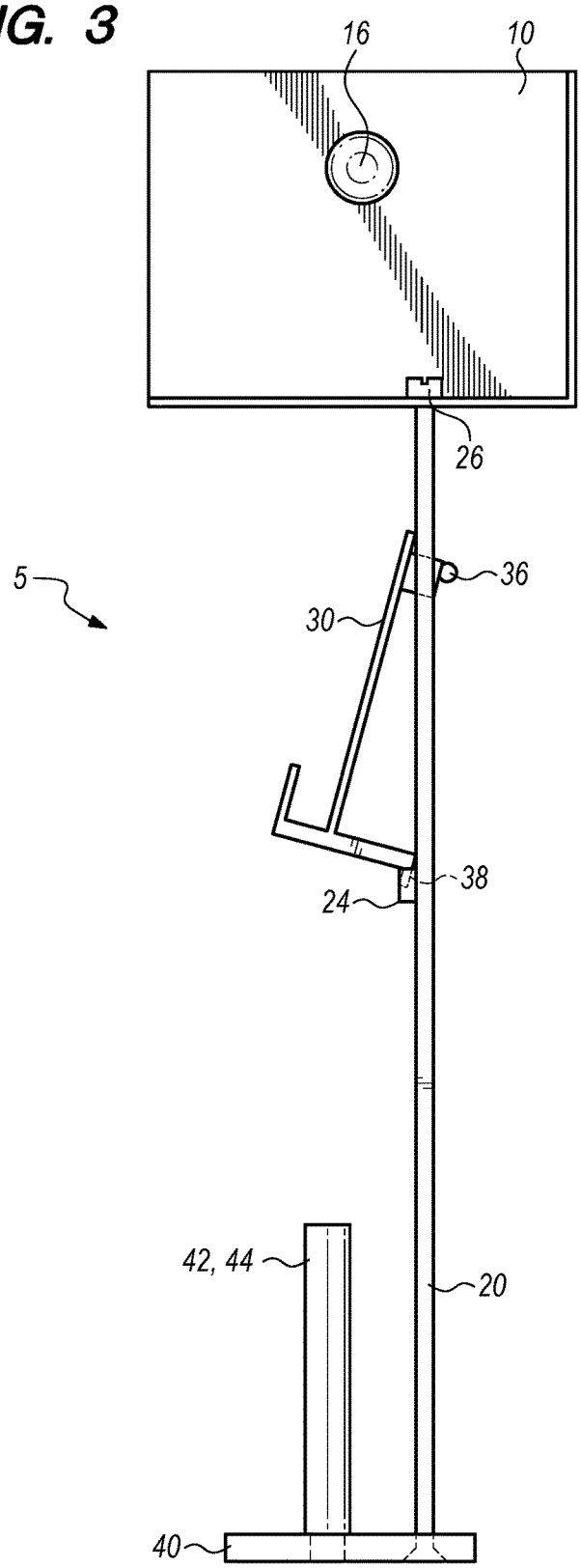
FIG. 3 is a left side elevation view of a first embodiment of modular toilet paper dispenser with shelf.

| Term | Definition |
|---|---|
| 5 | Modular Toilet Paper Dispenser with Shelf |
| 10 | Box Shaped Dispenser |
| 12 | L-Shaped Dispenser |
| 14 | Partial Box Dispenser |
| 15 | Wall Mounting Hole |
| 16 | Dispenser Rod |
| 17 | Dispenser Rod Hole |
| 18 | Dispenser Rod Cap |
| 19 | Stanchion Hole on Dispenser |
| 20 | Stanchion |
| 22 | Keyhole |
| 24 | Shelf Footing Bracket |
| 26 | Upper Stanchion Cap |
| 28 | Lower Stanchion Cap |
| 30 | Shelf |
| 36 | Shelf Key |
| 38 | Shelf Footing |
| 40 | Base |
| 42 | First Base Rod |
| 43 | First Threaded Hole |
| 44 | Second Base Rod |
| 45 | Second Threaded Hole |
| 46 | Stanchion Hole on Base |
| 50 | Roll of Toilet Paper or Toilet Tissue |

DETAILED DESCRIPTION OF THE INVENTION

Modular toilet paper dispenser with shelf 5 has a modular design that may be disassembled and assembled by hand without tools. Modular toilet paper dispenser with shelf 5 comprises four main modules: a dispenser 10, 12, or 14; a stanchion 20; a shelf 30; and a base 40. Each module may be disassembled and assembled by hand without tools. All components of each module may be disassembled and assembled by hand without tools. The modular aspect of modular toilet paper dispenser with shelf 5 allows the user to easily assemble toilet paper dispenser with shelf 5 with variously colored modules according to the user's taste or according to the season of the year. For instance, during the Christmas season, the user may assemble modular toilet paper dispenser with shelf 5 with red and white modules or modules with Christmas décor on them. During Halloween the user may assemble modular toilet paper dispenser with shelf 5 with orange and black modules, or modules with Halloween décor on them, and so forth. The modular aspect allows for an infinite amount of decorative combinations.

Modular toilet paper dispenser with shelf 5 comprises a toilet paper or toilet tissue dispenser. Toilet paper or toilet tissue dispenser may be: a box shaped dispenser 10, an L-shaped dispenser 12, or a partial box dispenser 14.

Box shaped dispenser 10 is a rigid three-sided box shaped member, cuboid shaped member, or rectangular cuboid shaped member as depicted in FIGS. 1-5. A box shaped member, cuboid shaped member, or rectangular cuboid shaped member normally has six sides. Box shaped dispenser 10 only has three sides. Box shaped dispenser 10 comprises: a first rigid planar member, a second rigid planar member, and a third rigid planar member. First rigid planar member is a rigid horizontal square-shaped or rectangular-shaped planar member with a front edge, a left edge, a rear edge, and a right edge. Second rigid planar member is a rigid vertical square-shaped or rectangular-shaped planar member with a front edge, a top edge, a rear edge, and a bottom edge. Third rigid planar member is a rigid vertical square-shaped or rectangular-shaped planar member with a left edge, a top edge, a right edge, and a bottom edge. First, second, and third rigid planar members are perpendicular to each other and are rigidly attached to each other. The left edge of first rigid planar member is rigidly attached to the bottom edge of second rigid member. The rear edge of first rigid planar member is rigidly attached to the bottom edge of third rigid member. The rear edge of second rigid planar member is rigidly attached to the left edge of third rigid member. This forms the three-sided box shaped member, cuboid shaped member, or rectangular cuboid shaped member as depicted. There are no gaps or voids in the corner of the three-sided box shaped member, cuboid shaped member, or rectangular cuboid shaped member. The design of the box shaped dispenser 10 allows for more efficient manufacturing by an injection molding process. First rigid planar member has a stanchion hole 19 therein. Stanchion hole 19 is a hole or void through first rigid planar member. Stanchion hole 19 may be circular, square, or rectangular. In best mode stanchion hole 19 is circular. Second rigid planar member has a dispenser rod hole 17 therein. Dispenser rod hole 17 is a hole or void through second rigid planar member. Dispenser rod hole 17 may be circular, square, or rectangular. In best mode dispenser rod hole 17 is circular. Third rigid planar member has a wall mounting hole 15 therein. Wall mounting hole 15 is a hole or void through third rigid planar member. Wall mounting hole 15 may be circular, square, or rectangular. In best mode wall mounting hole 15 is square. Box shaped dispenser 10 is mounted to a bathroom wall (not depicted) using a fastener (not depicted) and/or a wall mounting plate (not depicted). Any known method of attachment to the bathroom wall may be used. Box shaped dispenser 10 may be made of any known material such as metal, plastic, wood, or similar. Box shaped dispenser 10 may be made in any known color or finish. Box shaped dispenser 10 may be transparent, translucent, or opaque.

L-shaped dispenser 12 a rigid angular member as depicted in FIGS. 6-10. L-shaped dispenser 12 comprises: an L-shaped rigid planar member, a lower rigid planar member, and an upper rigid planar member. L-shaped rigid planar member is a rigid vertical planar member shaped like an inverted letter L. As depicted the L-shape is inverted or upside down. L-shaped rigid planar member has a lower bottom edge, an inner left edge, an upper bottom edge, an outer left edge, an upper edge, and a right edge. Lower rigid planar member is a rigid horizontal rectangular-shaped planar member with a front edge, a left edge, a right edge, and a rear edge. Upper rigid planar member is a rigid vertical rectangular-shaped planar member with a front edge, a top edge, a bottom edge, and a rear edge. L-shaped rigid planar member, lower rigid planar member, and upper rigid planar member are perpendicular to each other and are rigidly attached to each other. The rear edge of lower rigid planar member is rigidly attached to the lower bottom edge of L-shaped rigid member. The rear edge of upper rigid planar member is rigidly attached to the outer left edge of L-shaped rigid planar member. This forms the rigid angular member as depicted. The design of L-shaped dispenser 12 allows for more efficient manufacturing by a stamping process or die stamping process. Lower rigid planar member has a stanchion hole 19 therein. Stanchion hole 19 is a hole or void through lower rigid planar member. Stanchion hole 19 may be circular, square, or rectangular. In best mode stanchion hole 19 is circular. Upper rigid planar member has a dispenser rod hole 17 therein. Dispenser rod hole 17 is a hole or void through upper rigid planar member. Dispenser rod hole 17 may be circular, square, or rectangular. In best mode dispenser rod hole 17 is circular. L-shaped rigid planar member has a wall mounting hole 15 therein. Wall mounting hole 15 is a hole or void through L-shaped rigid planar member. Wall mounting hole 15 may be circular, square, or rectangular. In best mode wall mounting hole 15 is square. L-shaped dispenser 12 is mounted to a bathroom wall (not depicted) using a fastener (not depicted) and/or a wall mounting plate (not depicted). Any known method of attachment to the bathroom wall may be used. L-shaped dispenser 12 may be made of known material such as metal, plastic, wood, or similar. L-shaped dispenser 12 may be made in any known color or finish. L-shaped dispenser 12 may be transparent, translucent, or opaque.

L-shaped dispenser 12 may further comprise: a veneer or fascia that is removeably attachable to L-shaped rigid planar member; a veneer or fascia that is removeably attachable to lower rigid planar member; and a veneer or fascia that is removeably attachable to upper rigid planar member. Each veneer or fascia is a rigid planar member or rigid cover. Each veneer or fascia may be removeably attachable by any known means such as by clips, snaps, adhesive, magnets, detents, Velcro, tape, lamentation, or other. In best mode each veneer or fascia is removeably attachable by snaps or clips that snap onto or clip onto: the exposed edges of L-shaped rigid planar member, the exposed edges lower rigid planar member, and the exposed edges upper rigid planar member. Each veneer or fascia may be made of any known material such as metal, plastic, wood, or similar. Each veneer or fascia may be made in any known color or finish. Each veneer or fascia may be transparent, translucent, or opaque. Veneers or fasciae allow for an alternate method to change seasonal decoration or décor of partial L-shaped dispenser 12 without disassembly.

Partial box shaped dispenser 14 is a rigid three-sided member as depicted in FIGS. 11-15. Partial box shaped dispenser 14 comprises: a first rigid planar member, a second rigid planar member, and a third rigid planar member. First rigid planar member is a rigid horizontal square-shaped or rectangular-shaped planar member with a front edge, a left edge, a rear edge, and a right edge. Second rigid planar member is a rigid vertical square-shaped or rectangular-shaped planar member with a front edge, a top edge, a rear edge, and a bottom edge. Third rigid planar member is a rigid vertical square-shaped or rectangular-shaped planar member with a left edge, a top edge, a right edge, and a bottom edge. First, second, and third rigid planar members are perpendicular to each other and are rigidly attached to each other. The left edge of first rigid planar member is rigidly attached to the bottom edge of second rigid member. The rear edge of first rigid planar member is rigidly attached to the bottom edge of third rigid member. The rear edge of second rigid planar member is not attached to the left edge of third rigid member and there is a gap or void between these edges. This forms the three-sided partial box shaped member, cuboid shaped member, or rectangular cuboid shaped member as depicted. The design of partial box shaped dispenser 14 allows for more efficient manufacturing by a thermo molding or compression molding process. First rigid planar member has a stanchion hole 19 therein. Stanchion hole 19 is a hole or void through first rigid planar member. Stanchion hole 19 may be circular, square, or rectangular. In best mode stanchion hole 19 is circular. Second rigid planar member has a dispenser rod hole 17 therein. Dispenser rod hole 17 is a hole or void through second rigid planar member. Dispenser rod hole 17 may be circular, square, or rectangular. In best mode dispenser rod hole 17 is circular. Third rigid planar member has a wall mounting hole 15 therein. Wall mounting hole 15 is a hole or void through third rigid planar member. Wall mounting hole 15 may be circular, square, or rectangular. In best mode wall mounting hole 15 is square. Box shaped dispenser 10 is mounted to a bathroom wall (not depicted) using a fastener (not depicted) and/or a wall mounting plate (not depicted). Any known method of attachment to the bathroom wall may be used. Partial box shaped dispenser 14 may be made of any known material such as metal, plastic, wood, or similar. Partial box shaped dispenser 14 may be made in any known color or finish. Partial box shaped dispenser 14 may be transparent, translucent, or opaque.

Partial box shaped dispenser 14 may further comprise: a veneer or fascia that is removeably attachable to first rigid planar member; a veneer or fascia that is removeably attachable to second rigid planar member; and a veneer or fascia that is removeably attachable to third rigid planar member. Each veneer or fascia is a rigid planar member or rigid cover. Each veneer or fascia may be removeably attachable by any known means such as by clips, snaps, adhesive, magnets, detents, Velcro, tape, lamentation, or other. In best mode each veneer or fascia is removeably attachable by snaps or clips that snap onto or clip onto: the exposed edges of first rigid planar member, the exposed edges second rigid planar member, and the exposed edges third rigid planar member. Each veneer or fascia may be made of any known material such as metal, plastic, wood, or similar. Each veneer or fascia may be made in any known color or finish. Each veneer or fascia may be transparent, translucent, or opaque. Veneers or fasciae allow for an alternate method to change seasonal decoration or décor of partial box shaped dispenser 14 without disassembly.

Modular toilet paper dispenser with shelf 5 further comprises: a dispenser rod 16 and a dispenser rod cap 18. Dispenser rod 16 is a rigid oblong horizontal member with a circular, square, or rectangular shaped lateral cross section. In best mode dispenser rod 16 has a circular lateral cross section as depicted. Dispenser rod 16 has a first end and a second end. The first end of dispenser rod 16 has a male threaded member located thereon. The second end of dispenser rod 16 may have knob or bulbous member on it but this is not required. In best mode there is a knob or bulbous member on second end of dispenser rod as depicted but this is not required. The outer diameter of knob or bulbous member should be smaller than the inner diameter of a roll of toilet paper or toilet tissue 50.

Figure 4:
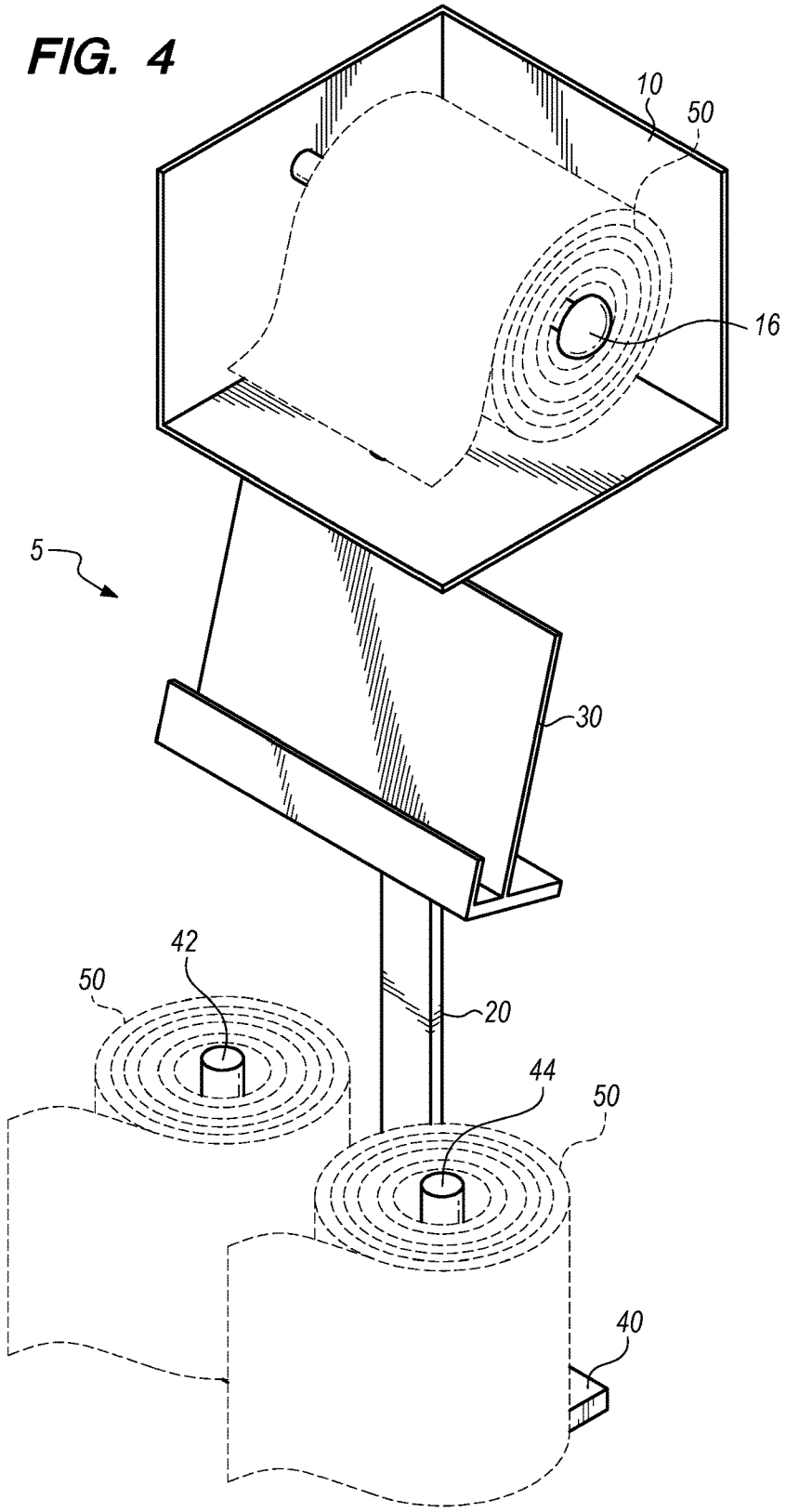
FIG. 4 is a perspective view of a first embodiment of modular toilet paper dispenser with shelf shown in an environment of use.
Figure 5:
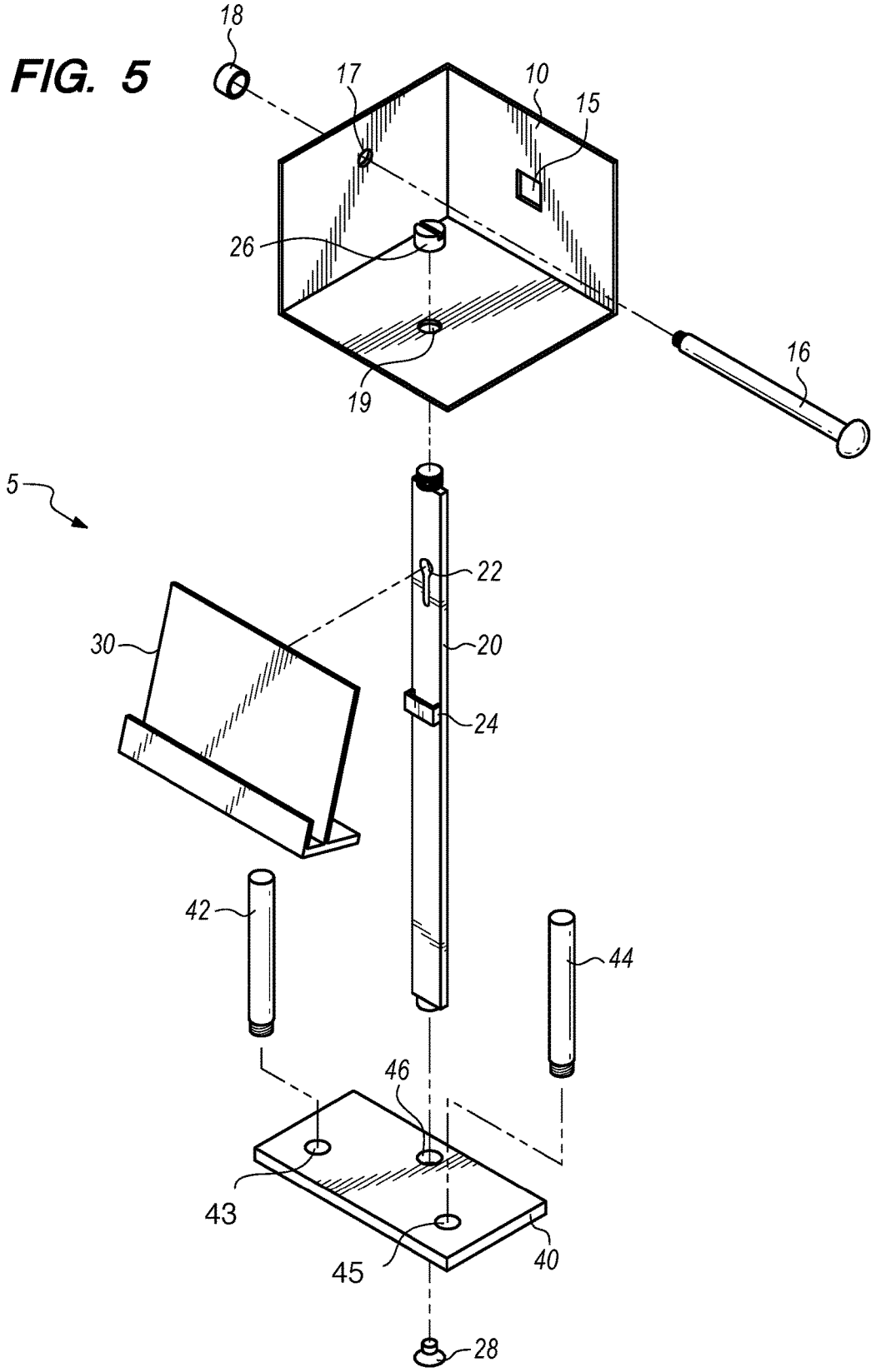
FIG. 5 is an exploded view of a first embodiment of modular toilet paper dispenser with shelf.
Figure 6:
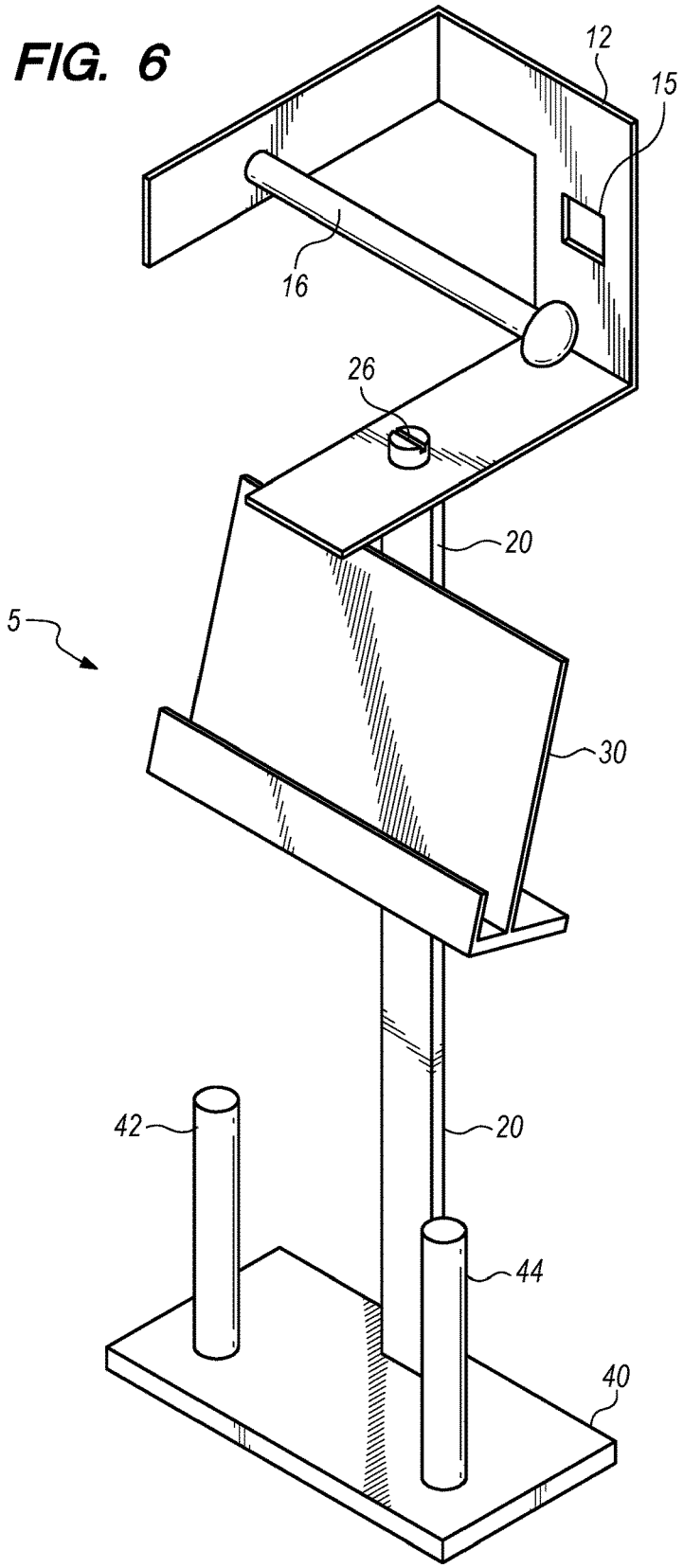
FIG. 6 is a perspective view of a second embodiment of modular toilet paper dispenser with shelf.
Figure 7:
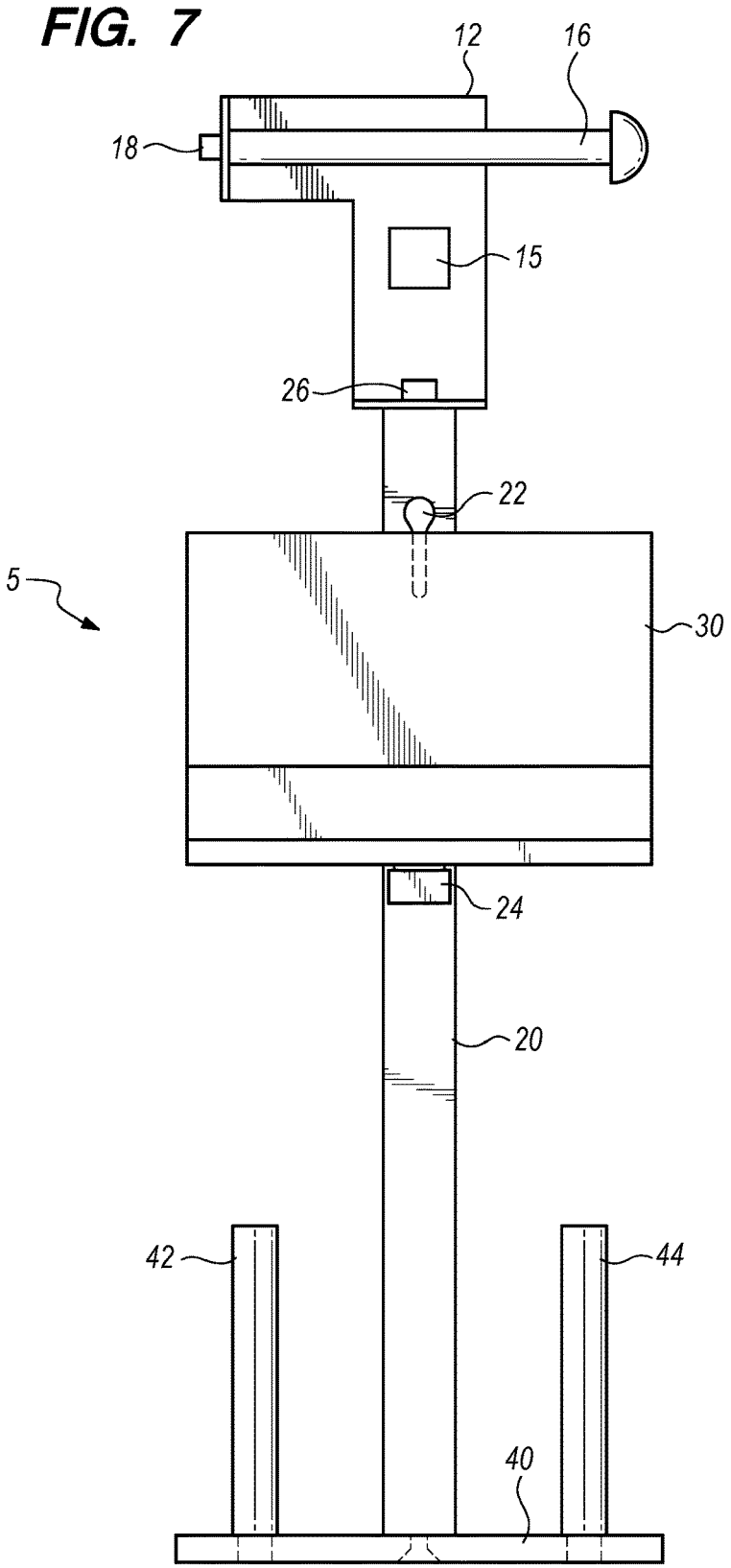
FIG. 7 is a front elevation view of a second embodiment of modular toilet paper dispenser with shelf.
Figure 8:
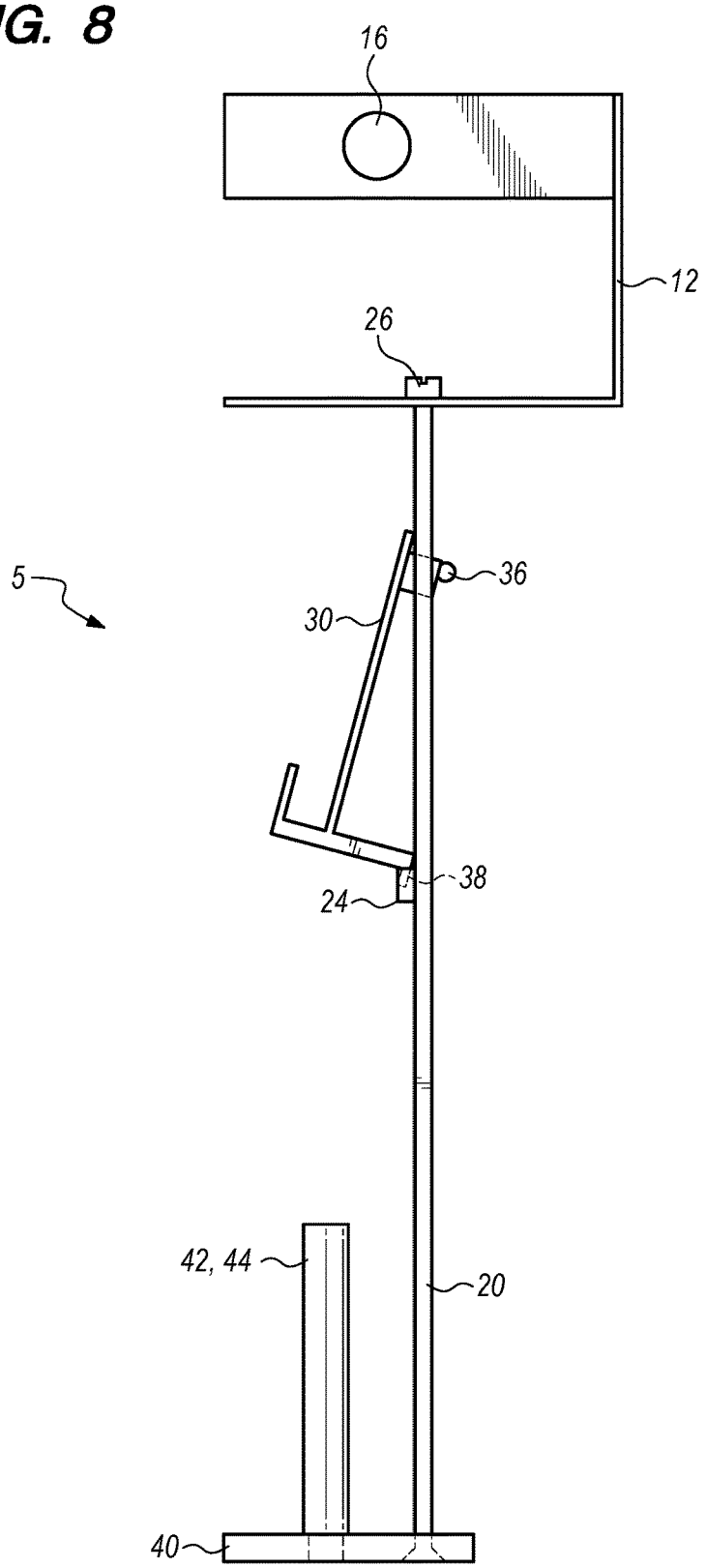
FIG. 8 is a left side elevation view of a second embodiment of modular toilet paper dispenser with shelf.
Figure 9:
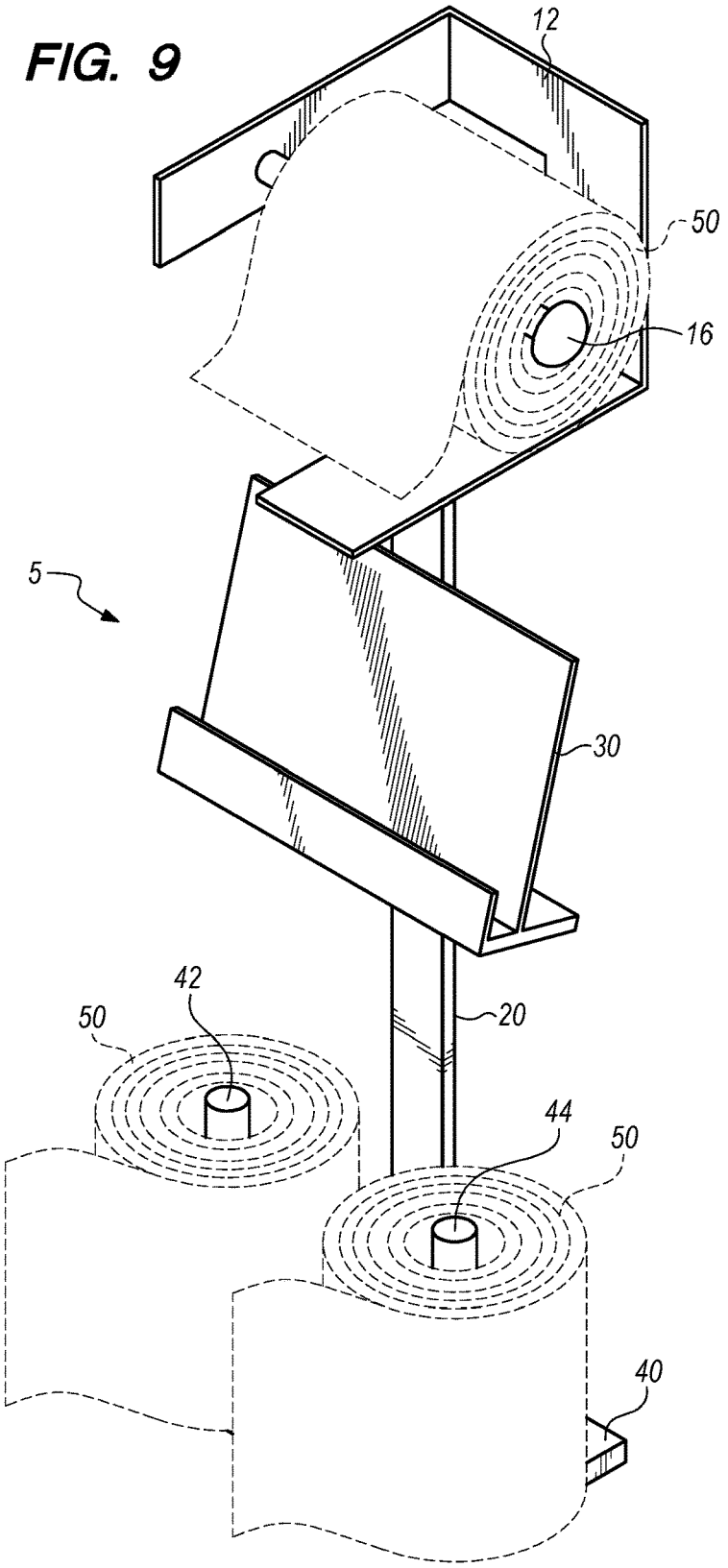
FIG. 9 is a perspective view of a second embodiment of modular toilet paper dispenser with shelf shown in an environment of use.
Figure 10:
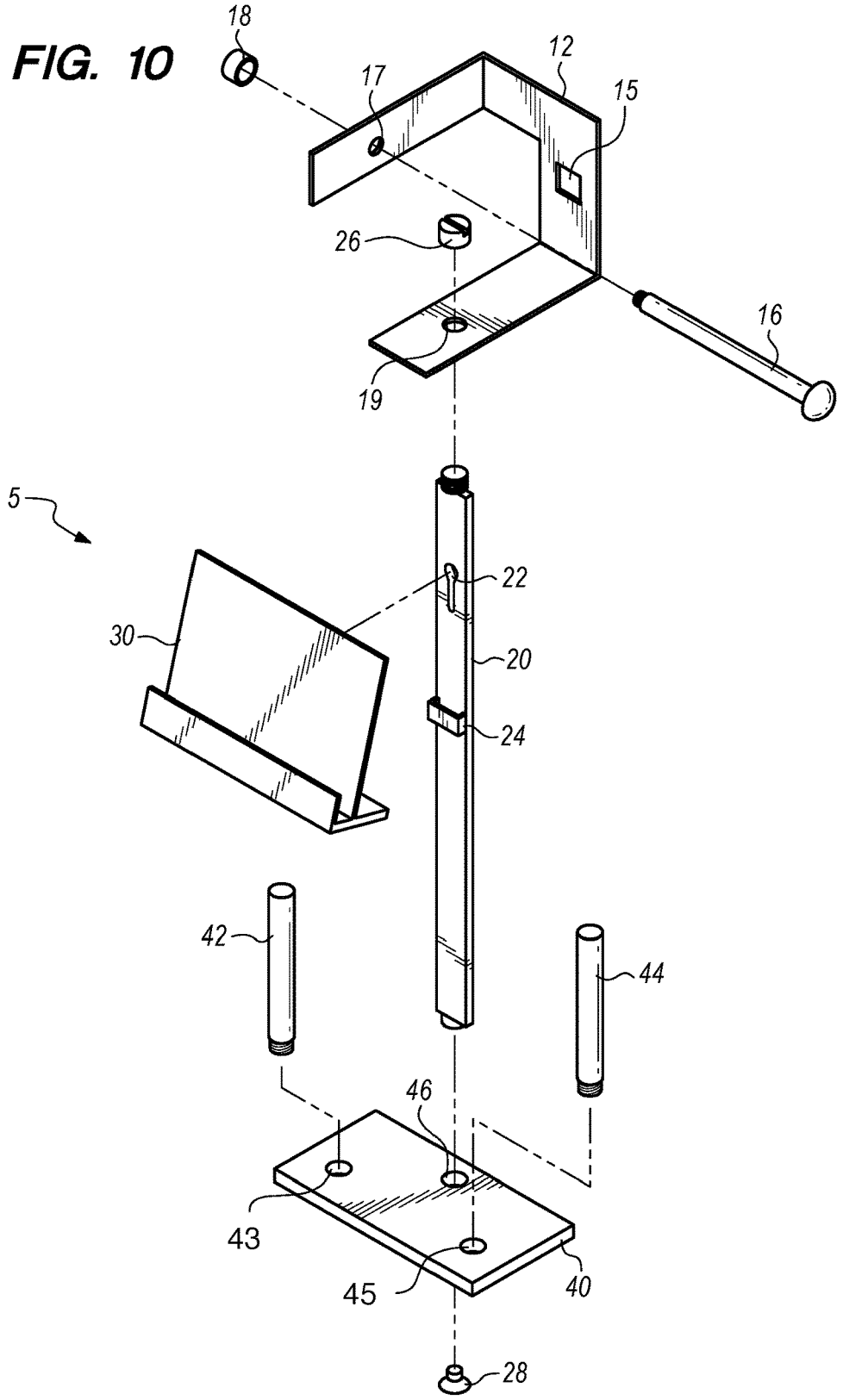
FIG. 10 is an exploded view of a second embodiment of modular toilet paper dispenser with shelf.
Figure 11:
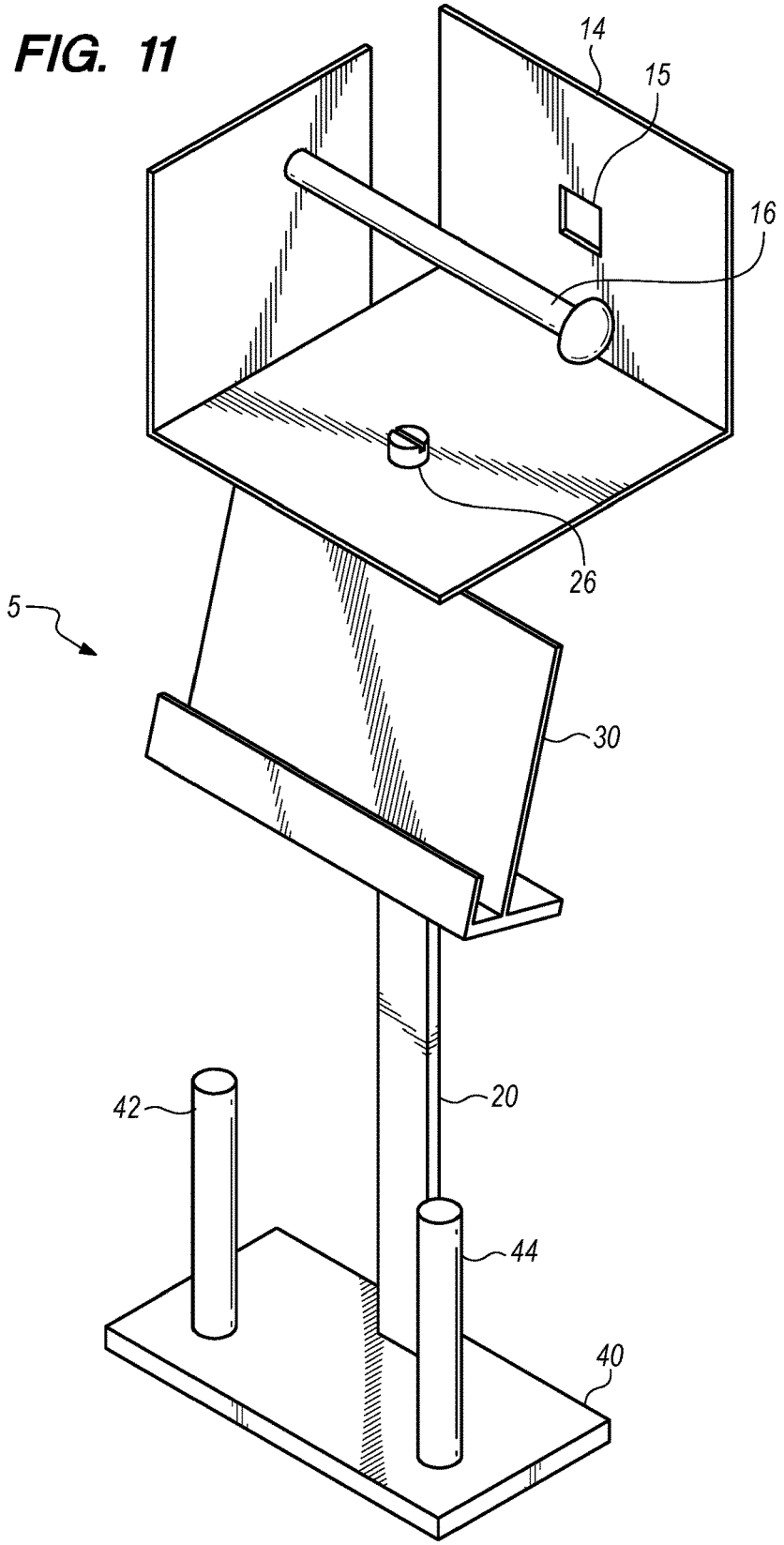
FIG. 11 is a perspective view of a third embodiment of modular toilet paper dispenser with shelf.
Figure 12:
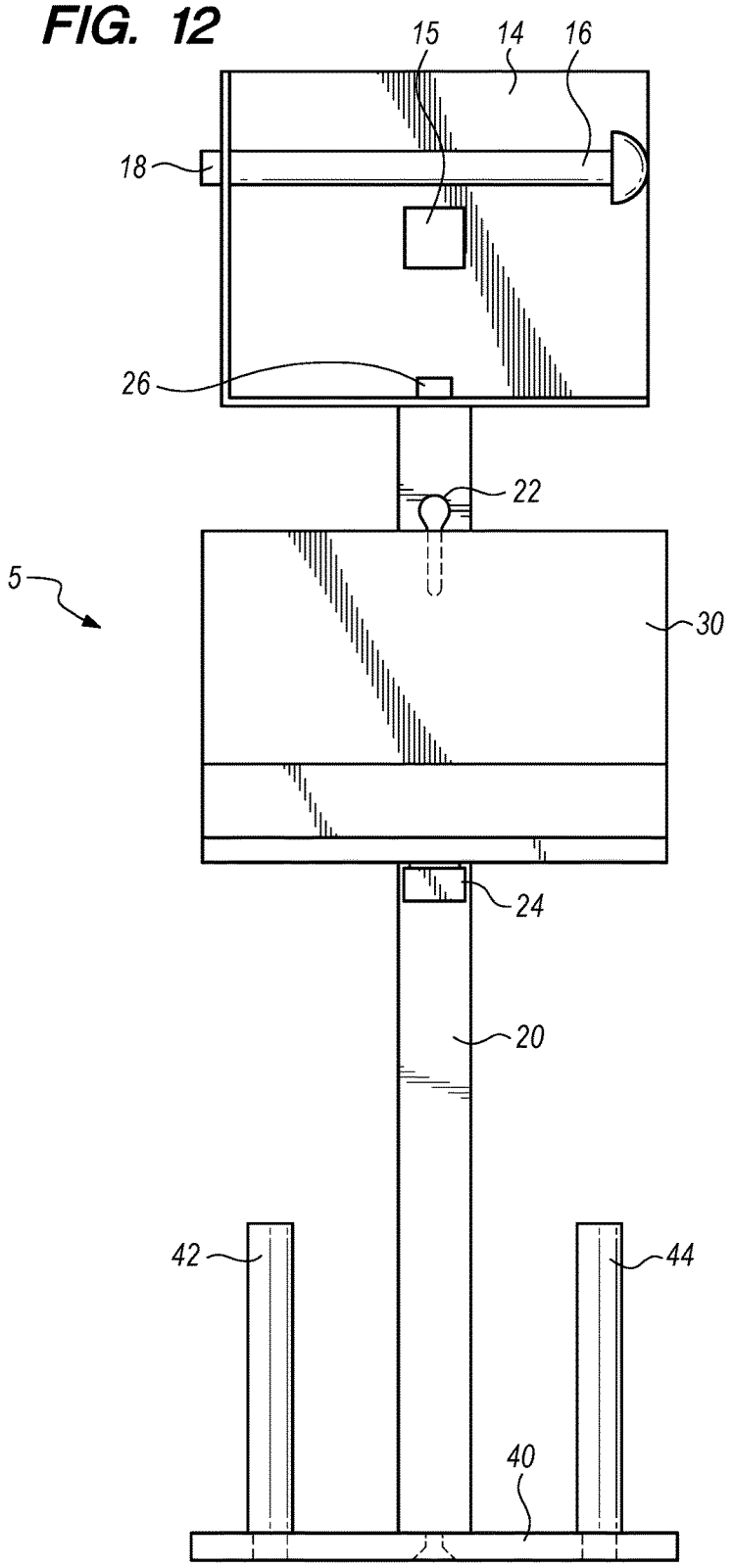
FIG. 12 is a front elevation view of a third embodiment of modular toilet paper dispenser with shelf.
Figure 13:
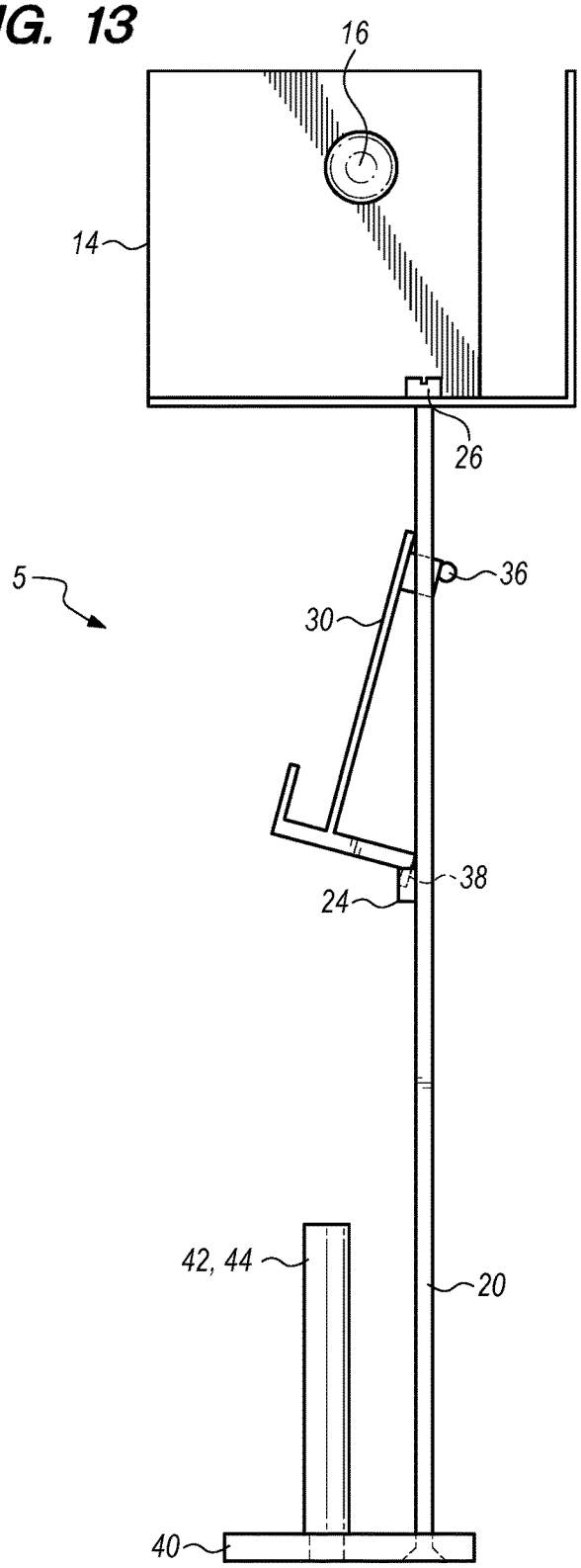
FIG. 13 is a left side elevation view of a third embodiment of modular toilet paper dispenser with shelf.
Figure 14:
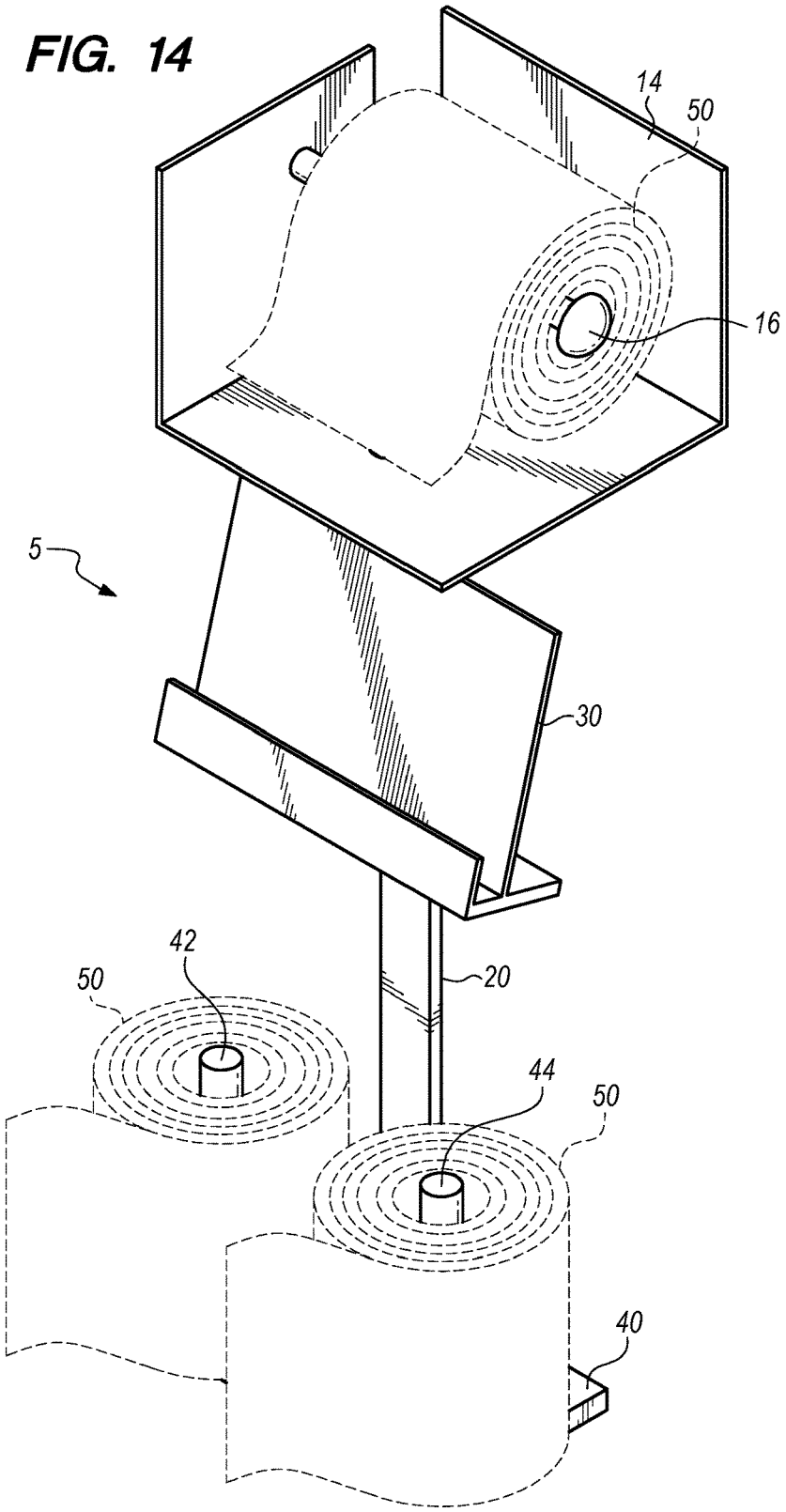
FIG. 14 is a perspective view of a third embodiment of modular toilet paper dispenser with shelf shown in an environment of use.
Figure 15:
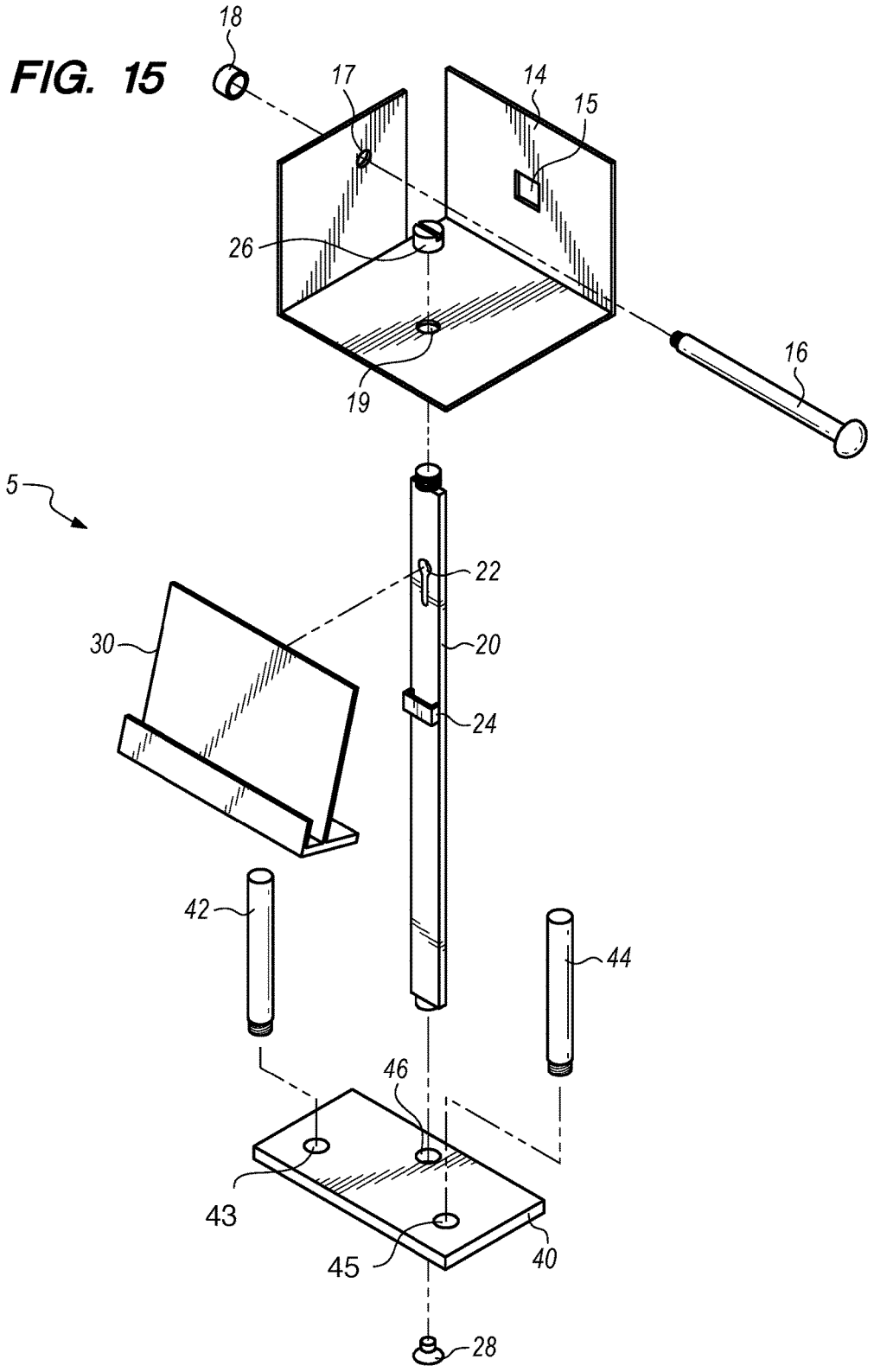
FIG. 15 is an exploded view of a third embodiment of modular toilet paper dispenser with shelf.

Dispenser rod cap 18 is a nut, screw cap, or cap member. Dispenser rod cap 18 has a female threaded member on a first end and a head member on a second end. Dispenser rod cap 18 is large enough to be held by the human hand and torqued or rotated by hand without the need for any tools such as a wrench or screwdriver. Head member on dispenser rod cap 18 may have ridges on it to allow for easier handling and rotation by fingers on a hand. Alternately, head member on dispenser rod cap 18 my have a slot or groove therein that is designed to mate with a coin or screwdriver that may be used to engage with upper stanchion cap 26 and help torque or rotate upper stanchion cap 26. Female threaded member on dispenser rod cap 18 engages with or mates with the male threaded member on the first end of dispenser rod 16. The female threads on dispenser rod cap 18 are sized to engage with or mate with the male threads on the first end of dispenser rod 16 and vice versa. Dispenser rod 16 and dispenser rod cap 18 are removeably attachable to: box shaped dispenser 10, L-shaped dispenser 12, and partial box dispenser 14. To attach dispenser rod 16 and dispenser rod cap 18, the first end of dispenser rod 16 is inserted through dispenser rod hole 17 in box shaped dispenser 10, L-shaped dispenser 12, or partial box dispenser 14 then the female threaded member on dispenser rod cap 18 is screwed onto or mated with the male threaded member on the first end of dispenser rod 16. The dispenser rod cap 18 is then tightened onto dispenser rod 16 to clamp down onto box shaped dispenser 10, L-shaped dispenser 12, or partial box dispenser 14 thereby rigidly attaching dispenser rod 16 to box shaped dispenser 10, L-shaped dispenser 12, or partial box dispenser 14. To remove dispenser rod 16 and dispenser rod cap 18 from box shaped dispenser 10, L-shaped dispenser 12, or partial box dispenser 14, the female threaded member on dispenser rod cap 18 is unscrewed from the male threaded member on the first end of dispenser rod 16 and removed therefrom to remove clamping pressure and to allow for the removal of dispenser rod 16 and dispenser rod cap 18 from box shaped dispenser 10, L-shaped dispenser 12, or partial box dispenser 14. Dispenser rod 16 functions to hold or dispense a roll of toilet paper or toilet tissue 50 as depicted in FIGS. 4, 9, and 14. A roll of toilet paper or toilet tissue 50 is removeably pivotally attachable to dispenser rod 16. A roll of toilet paper or toilet tissue 50 is pivotally attached to dispenser rod 16 by simply sliding the roll of toilet paper or toilet tissue 50 in over the second end of dispenser rod 16. A roll of toilet paper or toilet tissue 50 is removed from dispenser rod 16 by simply sliding the roll of toilet paper or toilet tissue 50 out over the second end of dispenser rod 16. Dispenser rod 16 may be made of any known material such as metal, plastic, wood, or similar. Dispenser rod 16 may be made in any known color or finish. Dispenser rod 16 may be transparent, translucent, or opaque. Dispenser rod cap 18 may be made of any known material such as metal, plastic, wood, or similar. Dispenser rod cap 18 may be made in any known color or finish. Dispenser rod cap 18 may be transparent, translucent, or opaque.

Modular toilet paper dispenser with shelf 5 further comprises: a stanchion 20; an upper stanchion cap 26; and a lower stanchion cap 28. Stanchion 20 is a rigid oblong member with a circular, square, or rectangular shaped lateral cross section. In best mode stanchion 20 has a rectangular lateral cross section as depicted. Stanchion 20 is about 0.5-4 inches wide and about 10-50 inches long. Stanchion 20 has a front side, a rear side, an upper end, and a lower end. Stanchion 20 has an upper half, a mid-point, a lower half, and a longitudinal axis. The upper end of stanchion 20 has a male threaded member located thereon. The lower end of stanchion 20 has a male threaded member located thereon. Upper stanchion cap 26 is a nut, screw cap, or cap member. Upper stanchion cap 26 has a female threaded member on a first end and a head member on a second end. Upper stanchion cap 26 is large enough to be held by the human hand and torqued or rotated by hand without the need for any tools such as a wrench or screwdriver. Head member on upper stanchion cap 26 may have ridges on it to allow for easier handling and rotation by fingers on a hand. Alternately, head member on upper stanchion cap 26 my have a slot or groove therein that is designed to mate with a coin or screwdriver that may be used to engage with upper stanchion cap 26 and help torque or rotate upper stanchion cap 26. Female threaded member on upper stanchion cap 26 engages with or mates with the male threaded member on the upper end of stanchion 20. The female threads on upper stanchion cap 26 are sized to engage with or mate with the male threads on the upper end of stanchion 20 and vice versa. Lower stanchion cap 28 is a nut, screw cap, or cap member. Lower stanchion cap 28 has a female threaded member on a first end and a head member on a second end. Lower stanchion cap 28 is large enough to be held by the human hand and torqued or rotated by hand without the need for any tools such as a wrench or screwdriver. Head member on lower stanchion cap 28 may have ridges on it to allow for easier handling and rotation by fingers on a hand. Alternately, head member on lower stanchion cap 28 my have a slot or groove therein that is designed to mate with a coin or screwdriver that may be used to engage with rotate lower stanchion cap 28 and help torque or rotate lower stanchion cap 28. Female threaded member on lower stanchion cap 28 engages with or mates with the male threaded member on the lower end of stanchion 20. The female threads on lower stanchion cap 28 are sized to engage with or mate with the male threads on the lower end of stanchion 20 and vice versa.

Stanchion 20 further comprises: a keyhole 22 and a shelf footing bracket 24. Keyhole 22 is a hole or void in the upper half of stanchion 20 penetrating through the front side and rear side of stanchion 20. Keyhole 22 is a vertical slot with a longitudinal axis that is parallel with that of stanchion 20. Vertical slot is about 0.125-1 inches wide and about 0.5-3 inches long. Keyhole 22 has an upper end and a lower end. The upper end of keyhole 22 has a circular hole there through with a diameter that is larger than the width of vertical slot. At the upper end of vertical slot there is a circular hole with a diameter that is larger than the width of vertical slot. Thus, keyhole 22 is a vertical slot with larger diameter hole at its upper end so that keyhole 22 essentially looks like a keyhole or is shaped like a keyhole as depicted. Shelf footing bracket 24 is a rigid C-shaped or U-shaped structural member. As the C-shape or U-shape dictates, shelf footing bracket 24 has an open end and a closed end. Shelf footing bracket 24 has a length or height of about 0.25-2 inches and a width that essentially matches that of stanchion 20. The open end of shelf footing bracket 24 is rigidly attached to the front side of stanchion 20 as depicted. The width dimension of shelf footing bracket 24 is perpendicular to the longitudinal axis of stanchion 20 as depicted. Shelf footing bracket 24 is rigidly attached to the front side of stanchion 20 at the mid-point of stanchion 20 or at 0-5 inches above or below the mid-point of stanchion 20. Shelf footing bracket 24 has an open top and an open bottom.

Stanchion 20 may further comprise: a veneer or fascia that is removeably attachable to its front side. Veneer or fascia is a rigid planar member or rigid cover. Veneer or fascia may be removeably attachable by any known means such as by clips, snaps, adhesive, magnets, detents, Velcro, tape, lamentation, or other. In best mode veneer or fascia is removeably attachable by snaps or clips that snap onto or clip onto the exposed edges of front side. Veneer or fascia may be made of any known material such as metal, plastic, wood, or similar. Veneer or fascia may be made in any known color or finish. Veneer or fascia may be transparent, translucent, or opaque. Veneer or fascia allows for an alternate method to change seasonal decoration or décor of stanchion 20 without disassembly.

Modular toilet paper dispenser with shelf 5 further comprises: a base 40; a first base rod 42; and a second base rod 44. Base 40 is a rigid horizontal square-shaped, rectangular-shaped, circular-shaped, or oval-shaped planar member with an upper side and a lower side. Base 40 has a stanchion hole 46 therein. Stanchion hole 46 is a hole or void through base 40. Stanchion hole 46 may be circular, square, or rectangular. In best mode stanchion hole 46 is circular as depicted. Base 40 has a first threaded hole 43 and second threaded hole 45 therein. First and second threaded holes 43,45 are each a threaded hole or void through base 40. First and second threaded holes 43,45 are each a tapped hole or a female threaded member. Base 40 functions to support stanchion 20, first base rod 42, and second base rod 44. Base 40 may be made of any known material such as metal, plastic, wood, or similar. Base 40 may be made in any known color or finish. Base 40 may be transparent, translucent, or opaque. First base rod 42 and second base rod 44 are each a rigid oblong vertical member with a circular, square, or rectangular shaped lateral cross section. In best mode first base rod 42 and second base rod 44 each have a circular lateral cross section as depicted. First base rod 42 and second base rod 44 each have an upper end and a lower end. The lower end of first base rod 42 and second base rod 44 each has a male threaded member located thereon. The female threaded member on first threaded hole 43 engages with or mates with the male threaded member on first base rod 42. The female threads on first threaded hole 43 are sized to engage with or mate with the male threads on first base rod 42 and vice versa. The female threaded member on second threaded hole 45 engages with or mates with the male threaded member on second base rod 44. The female threads on second threaded hole 45 are sized to engage with or mate with the male threads on second base rod 44 and vice versa. First base rod 42 is removeably attachable to base 40. First base rod 42 is attached to base 40 by screwing the male threaded member on first base rod 42 into first threaded hole 43. First base rod 42 is removed from base 40 by unscrewing the male threaded member on first base rod 42 from first threaded hole 43. Second base rod 44 is removeably attachable to base 40. Second base rod 44 is attached to base 40 by screwing the male threaded member on second base rod 44 into second threaded hole 45. Second base rod 44 is removed from base 40 by unscrewing the male threaded member on second base rod 44 from second threaded hole 45. First base rod 42 and second base rod 44 each function to hold a spare roll of toilet paper or toilet tissue 50 as depicted in FIGS. 4, 9, and 14. First base rod 42 and second base rod 44 each may be made of any known material such as metal, plastic, wood, or similar. First base rod 42 and second base rod 44 each may be made in any known color or finish. First base rod 42 and second base rod 44 each may be transparent, translucent, or opaque.

Base 40 may further comprise: a veneer or fascia that is removeably attachable to its upper side. Veneer or fascia is a rigid planar member or rigid cover. Veneer or fascia may be removeably attachable by any known means such as by clips, snaps, adhesive, magnets, detents, Velcro, tape, lamentation, or other. In best mode veneer or fascia is removeably attachable by snaps or clips that snap onto or clip onto the exposed edges of upper side. Veneer or fascia may be made of any known material such as metal, plastic, wood, or similar. Veneer or fascia may be made in any known color or finish. Veneer or fascia may be transparent, translucent, or opaque. Veneer or fascia allows for an alternate method to change seasonal decoration or décor of base 40 without disassembly.

Stanchion 20 is removeably attachable to box shaped dispenser 10, L-shaped dispenser 12, and partial box dispenser 14. To attach stanchion 20, the upper end of stanchion 20 is inserted through stanchion hole 19 in box shaped dispenser 10, L-shaped dispenser 12, or partial box dispenser 14 then the upper stanchion cap 26 is screwed onto the male threaded member on the upper end of stanchion 20. The upper stanchion cap 26 is then tightened onto stanchion 20 to clamp down onto box shaped dispenser 10, L-shaped dispenser 12, or partial box dispenser 14 thereby rigidly attaching stanchion 20 to box shaped dispenser 10, L-shaped dispenser 12, or partial box dispenser 14. To remove stanchion 20 and upper stanchion cap 26 from box shaped dispenser 10, L-shaped dispenser 12, or partial box dispenser 14, upper stanchion cap 26 is unscrewed from the male threaded member on the upper end of stanchion 20 and removed therefrom to remove clamping pressure and to allow for the removal of stanchion 20 and upper stanchion cap 26 from box shaped dispenser 10, L-shaped dispenser 12, or partial box dispenser 14.

Stanchion 20 is removeably attachable to base 40. To attach stanchion 20, the lower end of stanchion 20 is inserted through stanchion hole 46 in base 40 then the lower stanchion cap 28 is screwed onto the male threaded member on the lower end of stanchion 20. The lower stanchion cap 28 is then tightened onto stanchion 20 to clamp down onto base 40 thereby rigidly attaching stanchion 20 to base 40. To remove stanchion 20 and lower stanchion cap 28 from base 40, lower stanchion cap 28 is unscrewed from the male threaded member on the lower end of stanchion 20 and removed therefrom to remove clamping pressure and to allow for the removal of stanchion 20 and lower stanchion cap 28 from base 40.

Modular toilet paper dispenser with shelf 5 further comprises: a shelf 30; a shelf key 36; and a shelf footing 38. Shelf 30 is a shelf or easel for the placement of items. Shelf 30 comprises three rigid planar members rigidly attached to each other. Shelf 30 comprises: a base planar member, a front planar member, and a rear planar member. Base planar member is a rigid square-shaped or rectangular-shaped planar member with a front edge, a left edge, a rear edge, a right edge, an upper surface, a lower surface, a width, and a depth. Base planar member is generally horizontal or much more horizontal than vertical. Front planar member is a rigid square-shaped or rectangular-shaped planar member with an upper edge, a left edge, a lower edge, a right edge, a front surface, a rear surface, a width, and a height. Front planar member is generally vertical or much more vertical than horizontal. Rear planar member is a rigid square-shaped or rectangular-shaped planar member with an upper edge, a left edge, a lower edge, a right edge, a front surface, a rear surface, a width, a height, an upper half, and a lower half. Rear planar member is generally vertical or much more vertical than horizontal. Base member is perpendicular to both front and rear planar members. Front and rear planar members are parallel to each other. The bottom edge of rear planar member is rigidly attached to: the upper surface of base planar member or the rear edge of base planar member. In best mode, the bottom edge of rear planar member is rigidly attached to the upper surface base planar member as depicted. The front edge of base planar member is rigidly attached to the lower edge of front planar member. The widths of base planar member, front planar member, and rear planar member are equal. The right edges of base planar member, front planar member, and rear planar member are flush with each other. The left edges of base planar member, front planar member, and rear planar member are flush with each other. The height of rear planar member is greater than that of front planar member. Items may be placed on shelf 30 by placing the items in between the rear surface of front planar member and front surface of rear planar member and resting them on the upper surface of base planar member. In this way items are supported by the upper surface of base planar member and lean against the front surface of rear planar member. Items rest on shelf 30 the same way items rest onto an easel or easel like structure. Shelf key 36 is a specially shaped rigid protrusion extending outward from the rear surface of rear planar member. Shelf key 36 comprises: a vertical planar member and a sphere. Vertical planar member is rigid square-shaped or rectangular-shaped vertical planar member with a front edge, an upper edge, a rear edge, and a lower edge. Sphere is a rigid sphere-shaped member with a diameter and a surface. The diameter of sphere is greater than the width vertical slot on keyhole 22. The diameter of sphere is slightly smaller than the diameter circular hole on keyhole 22. The surface of sphere is rigidly attached to the rear edge of vertical planar member. The front edge of vertical planar member is rigidly attached to the rear surface of rear planar member of shelf 30 on the upper half of rear planar member on shelf 30. Shelf footing 38 is a rigid square-shaped or rectangular-shaped planar member with an upper edge, a right edge, a lower edge, left edge, and a width. Shelf footing 38 is perpendicular to base planar member. The upper edge of shelf footing 38 is rigidly attached to the lower surface of base planar member adjacent to the rear edge of base planar member or aligned with the rear edge of base planar member. The width of shelf footing 38 is slightly less than the width of stanchion 20. Shelf 30, shelf key 36, and shelf footing 38 may be made of any known material such as metal, plastic, wood, or similar. Shelf 30, shelf key 36, and shelf footing 38 may be made in any known color or finish. Shelf 30, shelf key 36, and shelf footing 38 may be transparent, translucent, or opaque.

Shelf 30 is removeably attachable to stanchion 20. To attach shelf 30 to stanchion 20, the sphere on shelf key 36 is aligned with and passed through the circular hole on keyhole 22 and the vertical planar member on shelf key 36 is slid downwards into the vertical slot on keyhole 22 so that the sphere on shelf key 36 is retained behind the vertical slot on keyhole 22. Simultaneously, the bottom edge of shelf footing 38 is aligned with and passed through the open top of shelf footing bracket 24 and lowered so that the bottom surface of base planar member of shelf 30 rests on top of shelf footing bracket 24. Shelf footing 38 rests within the open top of shelf footing bracket 24 and nests within shelf footing bracket 24. Shelf 30 is secured to stanchion 20 because sphere on shelf key 36 is pinned or locked behind vertical slot on keyhole 22 and shelf footing 38 is nested within shelf footing bracket 24. To remove shelf 30 from stanchion 20, the sphere on shelf key 36 is raised and aligned with the circular hole on keyhole 22 and slid backward through circular hole on keyhole 22. Simultaneously, the bottom edge of shelf footing 38 is raised above the open top of shelf footing bracket 24 and slid backwards to remove shelf 30 from stanchion 20.

Shelf 30 functions to allow for the placement of items thereon. Any item may be positioned or placed onto shelf 30 such as a cell phone, book, magazine, note pad, tablet computer, video screen, white board, illuminated white board, transparent note board, illuminated transparent note board, note board, illuminated note board etc. Modular toilet paper dispenser with shelf 5 may further comprise a power source such as a battery, direct current power source, or alternating current power source. Power source may be attached to shelf 30 or any part of modular toilet paper dispenser with shelf 5. Modular toilet paper dispenser with shelf 5 may further comprise one or more light sources or light bulbs. One or more light sources or light bulbs may be attached to shelf 30 or any part of modular toilet paper dispenser with shelf 5. Power source may be used to connect with and power one or more light sources or light bulbs. One or more light sources or light bulb may be used for decorative lighting or for functional lighting of items on shelf 30 or any part of modular toilet paper dispenser with shelf 5.

The fully assembled modular toilet paper dispenser with shelf 5 is attached or mounted to a bathroom wall (not depicted) near the toilet (not depicted). As stated above, modular toilet paper dispenser with shelf 5 is attached or mounted to a bathroom wall using a fastener (not depicted) and/or a wall mounting plate (not depicted). Any known method of attachment to the bathroom wall may be used. Modular toilet paper dispenser with shelf 5 is attached at a height above the bathroom floor (not depicted) so that base 40 of modular toilet paper dispenser with shelf 5 is not resting on the floor or touching the floor but is floating above the floor by some height. This allows for easier floor cleaning without interference or obstruction from modular toilet paper dispenser with shelf 5.

What is claimed is:

1. A toilet paper dispenser comprising: a box shaped dispenser; a dispenser rod; a dispenser rod cap; a stanchion, an upper stanchion cap; a lower stanchion cap; a base; a first base rod; a second base rod; and a shelf, wherein, said box shaped dispenser comprises: a first rigid planar member; a second rigid planar member; and a third rigid planar member, wherein, said first rigid planar member is a rigid horizontal square-shaped or rectangular-shaped planar member with a front edge, a left edge, a rear edge, and a right edge, said second rigid planar member is a rigid vertical square-shaped or rectangular-shaped planar member with a front edge, a top edge, a rear edge, and a bottom edge, said third rigid planar member is a rigid vertical square-shaped or rectangular-shaped planar member with a left edge, a top edge, a right edge, and a bottom edge, said first, second, and third rigid planar members are perpendicular to each other and are rigidly attached to each other, said left edge of said first rigid planar member is rigidly attached to said bottom edge of said second rigid member, said rear edge of said first rigid planar member is rigidly attached to said bottom edge of said third rigid member, said rear edge of said second rigid planar member is rigidly attached to said left edge of said third rigid member, said first rigid planar member has a stanchion hole, wherein, said stanchion hole is a hole or void through said first rigid planar member, said second rigid planar member has a dispenser rod hole, wherein, said dispenser rod hole is a hole or void through said second rigid planar member, said third rigid planar member has a wall mounting hole, wherein, said wall mounting hole is a hole or void through said third rigid planar member, said dispenser rod is a rigid oblong horizontal member with a circular, square, or rectangular shaped lateral cross section, a first end, and a second end, wherein, said first end has a male threaded member, said dispenser rod cap is a nut, screw cap, or cap member with a first end and a second end, wherein, said first end has a female threaded member, said dispenser rod and said dispenser rod cap are removeably attachable to said box shaped dispenser, wherein said first end of said dispenser rod is inserted through said dispenser rod hole on said box shaped dispenser and said female threaded member on said dispenser rod cap is screwed onto or mated with said male threaded member on said first end of said dispenser rod, said stanchion is a rigid oblong member with a circular, square, or rectangular shaped lateral cross section, a front side, a rear side, an upper end, a lower end, an upper half, a mid-point, a lower half, and a longitudinal axis, wherein, said upper end of said stanchion has a male threaded member, and said lower of said stanchion has a male threaded member, said stanchion further comprises: a keyhole and a shelf footing bracket, wherein, said keyhole is a hole or void in said upper half of said stanchion that is a vertical slot with a longitudinal axis, a width, a length, an upper end, and a lower end, said longitudinal axis of said keyhole is parallel with that of said stanchion, said upper end of said vertical slot has a circular hole with a diameter that is larger than said width of said vertical slot, said shelf footing bracket is a rigid C-shaped or U-shaped structural member with an open end and a closed end, said open end of said shelf footing bracket is rigidly attached to said front side of said stanchion, said shelf footing bracket has an open top and an open bottom, said upper stanchion cap is a nut, screw cap, or cap member with a first end and a second end, wherein, said first end has a female threaded member, said lower stanchion cap is a nut, screw cap, or cap member with a first end and a second end, wherein, said first end has a female threaded member, said base is a rigid horizontal square-shaped, rectangular-shaped, circular-shaped, or oval-shaped planar member with an upper side, a lower side, a stanchion hole, a first threaded hole, and a second threaded hole, said stanchion hole in said base that is a hole or void through said base, said first threaded hole is a threaded hole or void through said base that is a tapped hole with a female threaded member, said second threaded hole is a threaded hole or void through said base that is a tapped hole with a female threaded member, said first base rod is a rigid oblong vertical member with a circular, square, or rectangular shaped lateral cross section, an upper end, and a lower end, wherein said lower end has a male threaded member, said second base rod is a rigid oblong vertical member with a circular, square, or rectangular shaped lateral cross section, an upper end, and a lower end, wherein said lower end has a male threaded member, said first base rod is removeably attachable to said base, wherein said male threaded member on said first base rod is screwed onto or mated with said female threaded member on said first threaded hole, said second base rod is removeably attachable to said base, wherein said male threaded member on said second base rod is screwed onto or mated with said female threaded member on said second threaded hole, said stanchion is removeably attachable to said box shaped dispenser, wherein said male threaded member on said upper end of said stanchion is inserted through said stanchion hole on said box shaped dispenser and said female threaded member on said upper stanchion cap is screwed onto or mated with said male threaded member of said upper end of said stanchion, said stanchion is removeably attachable to said base, wherein said male threaded member on said lower end of said stanchion is inserted through said stanchion hole on said base and said female threaded member on said lower stanchion cap is screwed onto or mated with said male threaded member said lower end of said stanchion, said shelf comprises: a base planar member; a front planar member; and a rear planar member, wherein, said base planar member is a rigid square-shaped or rectangular-shaped planar member with a front edge, a left edge, a rear edge, a right edge, an upper surface, a lower surface, a width, and a depth, said front planar member is a rigid square-shaped or rectangular-shaped planar member with an upper edge, a left edge, a lower edge, a right edge, a front surface, a rear surface, a width, and a height, said rear planar member is a rigid square-shaped or rectangular-shaped planar member with an upper edge, a left edge, a lower edge, a right edge, a front surface, a rear surface, a width, a height, an upper half, and a lower half, said base member is perpendicular to said front planar member and to said rear planar member, said front planar member is parallel to said rear planar member, said bottom edge of said rear planar member is rigidly attached to said upper surface of said base planar member or to said rear edge of said base planar member, said front edge of said base planar member is rigidly attached to said lower edge of said front planar member, said widths of said base planar member, said front planar member, and said rear planar member are equal, said shelf further comprises a shelf key, said shelf key has a vertical planar member and a sphere, wherein, said vertical planar member is rigid square-shaped or rectangular-shaped vertical planar member with a front edge, an upper edge, a rear edge, and a lower edge, said sphere is a rigid sphere-shaped member with a diameter and a surface, said diameter of said sphere is greater than said width of said vertical slot on said keyhole, said diameter of sphere is smaller than said diameter on said circular hole on said keyhole, said surface of sphere is rigidly attached to said rear edge of said vertical planar member, said front edge of said vertical planar member is rigidly attached to said rear surface of said rear planar member of said shelf, said shelf further comprises a shelf footing, said shelf footing is a rigid square-shaped or rectangular-shaped planar member with an upper edge, a right edge, a lower edge, left edge, and a width, said shelf footing is perpendicular to said base planar member of said shelf, said upper edge of said shelf footing is rigidly attached to said lower surface of said base planar, and said shelf is removeably attachable to said stanchion, wherein said sphere on said shelf key is aligned with and passed through said circular hole on said keyhole and slid downwards into said vertical slot on said keyhole so that said sphere is retained behind said vertical slot on said keyhole (22), and, simultaneously, said bottom edge of said shelf footing is aligned with and passed through said open top of said shelf footing bracket and lowered so that said bottom surface of said base planar member of said shelf rests on top of said shelf footing bracket.

2. A toilet paper dispenser comprising: a L-shaped dispenser; a dispenser rod; a dispenser rod cap; a stanchion, an upper stanchion cap; a lower stanchion cap; a base; a first base rod; a second base rod; and a shelf, wherein, said L-shaped dispenser comprises: an L-shaped rigid planar member, a lower rigid planar member, and an upper rigid planar member, said L-shaped rigid planar member is a rigid vertical planar member shaped like an inverted letter L with a lower bottom edge, an inner left edge, an upper bottom edge, an outer left edge, an upper edge, and a right edge, said lower rigid planar member is a rigid horizontal rectangular-shaped planar member with a front edge, a left edge, a right edge, and a rear edge, said upper rigid planar member is a rigid vertical rectangular-shaped planar member with a front edge, a top edge, a bottom edge, and a rear edge, said L-shaped rigid planar member, said lower rigid planar member, and said upper rigid planar member are perpendicular to each other and are rigidly attached to each other, said rear edge of said lower rigid planar member is rigidly attached to said lower bottom edge of said L-shaped rigid planar member, said rear edge of said upper rigid planar member is rigidly attached to said outer left edge of said L-shaped rigid planar member, said lower rigid planar member has a stanchion hole, wherein said stanchion hole is a hole or void through said lower rigid planar member, said upper rigid planar member has a dispenser rod hole, wherein said dispenser rod hole is a hole or void through said upper rigid planar member, said L-shaped rigid planar member has a wall mounting hole, wherein said wall mounting hole is a hole or void through said L-shaped rigid planar member, said dispenser rod is a rigid oblong horizontal member with a circular, square, or rectangular shaped lateral cross section, a first end, and a second end, wherein, said first end has a male threaded member, said dispenser rod cap is a nut, screw cap, or cap member with a first end and a second end, wherein, said first end has a female threaded member, said dispenser rod and said dispenser rod cap are removeably attachable to said L-shaped dispenser, wherein said first end of said dispenser rod is inserted through said dispenser rod hole on said L-shaped dispenser and said female threaded member on said dispenser rod cap is screwed onto or mated with said male threaded member on said first end of said dispenser rod, said stanchion is a rigid oblong member with a circular, square, or rectangular shaped lateral cross section, a front side, a rear side, an upper end, a lower end, an upper half, a mid-point, a lower half, and a longitudinal axis, wherein, said upper end of said stanchion has a male threaded member, and said lower of said stanchion has a male threaded member, said stanchion further comprises: a keyhole and a shelf footing bracket, wherein, said keyhole is a hole or void in said upper half of said stanchion that is a vertical slot with a longitudinal axis, a width, a length, an upper end, and a lower end, said longitudinal axis of said keyhole is parallel with that of said stanchion, said upper end of said vertical slot has a circular hole with a diameter that is larger than said width of said vertical slot, said shelf footing bracket is a rigid C-shaped or U-shaped structural member with an open end and a closed end, said open end of said shelf footing bracket is rigidly attached to said front side of said stanchion, said shelf footing bracket has an open top and an open bottom, said upper stanchion cap is a nut, screw cap, or cap member with a first end and a second end, wherein, said first end has a female threaded member, said lower stanchion cap is a nut, screw cap, or cap member with a first end and a second end, wherein, said first end has a female threaded member, said base is a rigid horizontal square-shaped, rectangular-shaped, circular-shaped, or oval-shaped planar member with an upper side, a lower side, a stanchion hole, a first threaded hole, and a second threaded hole, said stanchion hole in said base that is a hole or void through said base, said first threaded hole is a threaded hole or void through said base that is a tapped hole with a female threaded member, said second threaded hole is a threaded hole or void through said base that is a tapped hole with a female threaded member, said first base rod is a rigid oblong vertical member with a circular, square, or rectangular shaped lateral cross section, an upper end, and a lower end, wherein said lower end has a male threaded member, said second base rod is a rigid oblong vertical member with a circular, square, or rectangular shaped lateral cross section, an upper end, and a lower end, wherein said lower end has a male threaded member, said first base rod is removeably attachable to said base, wherein said male threaded member on said first base rod is screwed onto or mated with said female threaded member on said first threaded hole, said second base rod is removeably attachable to said base, wherein said male threaded member on said second base rod is screwed onto or mated with said female threaded member on said second threaded hole, said stanchion is removeably attachable to said L-shaped dispenser, wherein said male threaded member on said upper end of said stanchion is inserted through said stanchion hole on said L-shaped dispenser and said female threaded member on said upper stanchion cap is screwed onto or mated with said male threaded member of said upper end of said stanchion, said stanchion is removeably attachable to said base, wherein said male threaded member on said lower end of said stanchion is inserted through said stanchion hole on said base and said female threaded member on said lower stanchion cap is screwed onto or mated with said male threaded member of said lower end of said stanchion, said shelf comprises: a base planar member; a front planar member; and a rear planar member, wherein, said base planar member is a rigid square-shaped or rectangular-shaped planar member with a front edge, a left edge, a rear edge, a right edge, an upper surface, a lower surface, a width, and a depth, said front planar member is a rigid square-shaped or rectangular-shaped planar member with an upper edge, a left edge, a lower edge, a right edge, a front surface, a rear surface, a width, and a height, said rear planar member is a rigid square-shaped or rectangular-shaped planar member with an upper edge, a left edge, a lower edge, a right edge, a front surface, a rear surface, a width, a height, an upper half, and a lower half, said base member is perpendicular to said front planar member and to said rear planar member, said front planar member is parallel to said rear planar member, said bottom edge of said rear planar member is rigidly attached to said upper surface of said base planar member or to said rear edge of said base planar member, said front edge of said base planar member is rigidly attached to said lower edge of said front planar member, said widths of said base planar member, said front planar member, and said rear planar member are equal, said shelf further comprises a shelf key, said shelf key has a vertical planar member and a sphere, wherein, said vertical planar member is rigid square-shaped or rectangular-shaped vertical planar member with a front edge, an upper edge, a rear edge, and a lower edge, said sphere is a rigid sphere-shaped member with a diameter and a surface, said diameter of said sphere is greater than said width of said vertical slot on said keyhole, said diameter of sphere is smaller than said diameter on said circular hole on said keyhole, said surface of sphere is rigidly attached to said rear edge of said vertical planar member, said front edge of said vertical planar member is rigidly attached to said rear surface of said rear planar member of said shelf, said shelf further comprises a shelf footing, said shelf footing is a rigid square-shaped or rectangular-shaped planar member with an upper edge, a right edge, a lower edge, left edge, and a width, said shelf footing is perpendicular to said base planar member of said shelf, said upper edge of said shelf footing is rigidly attached to said lower surface of said base planar, and said shelf is removeably attachable to said stanchion, wherein said sphere on said shelf key is aligned with and passed through said circular hole on said keyhole and slid downwards into said vertical slot on said keyhole so that said sphere is retained behind said vertical slot on said keyhole (22), and, simultaneously, said bottom edge of said shelf footing is aligned with and passed through said open top of said shelf footing bracket and lowered so that said bottom surface of said base planar member of said shelf rests on top of said shelf footing bracket.

3. A toilet paper dispenser comprising: a partial box shaped dispenser; a dispenser rod; a dispenser rod cap; a stanchion, an upper stanchion cap; a lower stanchion cap; a base; a first base rod; a second base rod; and a shelf, wherein, said partial box shaped dispenser comprises: a first rigid planar member; a second rigid planar member; and a third rigid planar member, wherein, said first rigid planar member is a rigid horizontal square-shaped or rectangular-shaped planar member with a front edge, a left edge, a rear edge, and a right edge, said second rigid planar member is a rigid vertical square-shaped or rectangular-shaped planar member with a front edge, a top edge, a rear edge, and a bottom edge, said third rigid planar member is a rigid vertical square-shaped or rectangular-shaped planar member with a left edge, a top edge, a right edge, and a bottom edge, said first, second, and third rigid planar members are perpendicular to each other and are rigidly attached to each other, said left edge of said first rigid planar member is rigidly attached to said bottom edge of said second rigid member, said rear edge of said first rigid planar member is rigidly attached to said bottom edge of said third rigid member, said rear edge of said second rigid planar member is not attached to said left edge of said third rigid member leaving a gap or void there between, said first rigid planar member has a stanchion hole, wherein, said stanchion hole is a hole or void through said first rigid planar member, said second rigid planar member has a dispenser rod hole, wherein, said dispenser rod hole is a hole or void through said second rigid planar member, said third rigid planar member has a wall mounting hole, wherein, said wall mounting hole is a hole or void through said third rigid planar member, said dispenser rod is a rigid oblong horizontal member with a circular, square, or rectangular shaped lateral cross section, a first end, and a second end, wherein, said first end has a male threaded member, said dispenser rod cap is a nut, screw cap, or cap member with a first end and a second end, wherein, said first end has a female threaded member, said dispenser rod and said dispenser rod cap are removeably attachable to said partial box shaped dispenser, wherein said first end of said dispenser rod is inserted through said dispenser rod hole on said partial box shaped dispenser and said female threaded member on said dispenser rod cap is screwed onto or mated with said male threaded member on said first end of said dispenser rod, said stanchion is a rigid oblong member with a circular, square, or rectangular shaped lateral cross section, a front side, a rear side, an upper end, a lower end, an upper half, a mid-point, a lower half, and a longitudinal axis, wherein, said upper end of said stanchion has a male threaded member, and said lower of said stanchion has a male threaded member, said stanchion further comprises: a keyhole and a shelf footing bracket, wherein, said keyhole is a hole or void in said upper half of said stanchion that is a vertical slot with a longitudinal axis, a width, a length, an upper end, and a lower end, said longitudinal axis of said keyhole is parallel with that of said stanchion, said upper end of said vertical slot has a circular hole with a diameter that is larger than said width of said vertical slot, said shelf footing bracket is a rigid C-shaped or U-shaped structural member with an open end and a closed end, said open end of said shelf footing bracket is rigidly attached to said front side of said stanchion, said shelf footing bracket has an open top and an open bottom, said upper stanchion cap is a nut, screw cap, or cap member with a first end and a second end, wherein, said first end has a female threaded member, said lower stanchion cap is a nut, screw cap, or cap member with a first end and a second end, wherein, said first end has a female threaded member, said base is a rigid horizontal square-shaped, rectangular-shaped, circular-shaped, or oval-shaped planar member with an upper side, a lower side, a stanchion hole, a first threaded hole, and a second threaded hole, said stanchion hole in said base that is a hole or void through said base, said first threaded hole is a threaded hole or void through said base that is a tapped hole with a female threaded member, said second threaded hole is a threaded hole or void through said base that is a tapped hole with a female threaded member, said first base rod is a rigid oblong vertical member with a circular, square, or rectangular shaped lateral cross section, an upper end, and a lower end, wherein said lower end has a male threaded member, said second base rod is a rigid oblong vertical member with a circular, square, or rectangular shaped lateral cross section, an upper end, and a lower end, wherein said lower end has a male threaded member, said first base rod is removeably attachable to said base, wherein said male threaded member on said first base rod is screwed onto or mated with said female threaded member on said first threaded hole, said second base rod is removeably attachable to said base, wherein said male threaded member on said second base rod is screwed onto or mated with said female threaded member on said second threaded hole, said stanchion is removeably attachable to said partial box shaped dispenser, wherein said male threaded member on said upper end of said stanchion is inserted through said stanchion hole on said partial box shaped dispenser and said female threaded member on said upper stanchion cap is screwed onto or mated with said male threaded member of said upper end of said stanchion, said stanchion is removeably attachable to said base, wherein said male threaded member on said lower end of said stanchion is inserted through said stanchion hole on said base and said female threaded member on said lower stanchion cap is screwed onto or mated with said male threaded member of said lower end of said stanchion, said shelf comprises: a base planar member; a front planar member; and a rear planar member, wherein, said base planar member is a rigid square-shaped or rectangular-shaped planar member with a front edge, a left edge, a rear edge, a right edge, an upper surface, a lower surface, a width, and a depth, said front planar member is a rigid square-shaped or rectangular-shaped planar member with an upper edge, a left edge, a lower edge, a right edge, a front surface, a rear surface, a width, and a height, said rear planar member is a rigid square-shaped or rectangular-shaped planar member with an upper edge, a left edge, a lower edge, a right edge, a front surface, a rear surface, a width, a height, an upper half, and a lower half, said base member is perpendicular to said front planar member and to said rear planar member, said front planar member is parallel to said rear planar member, said bottom edge of said rear planar member is rigidly attached to said upper surface of said base planar member or to said rear edge of said base planar member, said front edge of said base planar member is rigidly attached to said lower edge of said front planar member, said widths of said base planar member, said front planar member, and said rear planar member are equal, said shelf further comprises a shelf key, said shelf key has a vertical planar member and a sphere, wherein, said vertical planar member is rigid square-shaped or rectangular-shaped vertical planar member with a front edge, an upper edge, a rear edge, and a lower edge, said sphere is a rigid sphere-shaped member with a diameter and a surface, said diameter of said sphere is greater than said width of said vertical slot on said keyhole, said diameter of sphere is smaller than said diameter on said circular hole on said keyhole, said surface of sphere is rigidly attached to said rear edge of said vertical planar member, said front edge of said vertical planar member is rigidly attached to said rear surface of said rear planar member of said shelf, said shelf further comprises a shelf footing, said shelf footing is a rigid square-shaped or rectangular-shaped planar member with an upper edge, a right edge, a lower edge, left edge, and a width, said shelf footing is perpendicular to said base planar member of said shelf, said upper edge of said shelf footing is rigidly attached to said lower surface of said base planar, and said shelf is removeably attachable to said stanchion, wherein said sphere on said shelf key is aligned with and passed through said circular hole on said keyhole and slid downwards into said vertical slot on said keyhole so that said sphere is retained behind said vertical slot on said keyhole (22), and, simultaneously, said bottom edge of said shelf footing is aligned with and passed through said open top of said shelf footing bracket and lowered so that said bottom surface of said base planar member of said shelf rests on top of said shelf footing bracket.

* * * * *